US005342742A

United States Patent [19]

Naruse et al.

[11] Patent Number: 5,342,742

[45] Date of Patent: * Aug. 30, 1994

[54] SILVER HALIDE COLOR PHOTOGRAPHIC LIGHT-SENSITIVE MATERIAL COMPRISING A PYRROLOTRIAZOLE CYAN COUPLER AND A SPECIFIC YELLOW COUPLER

[75] Inventors: Hideaki Naruse; Makoto Suzuki; Takehiko Sato, all of Kanagawa, Japan

[73] Assignee: Fuji Photo Film Co., Ltd., Kanagawa, Japan

[ * ] Notice: The portion of the term of this patent subsequent to Oct. 26, 2010 has been disclaimed.

[21] Appl. No.: 982,573

[22] Filed: Nov. 27, 1992

[30] Foreign Application Priority Data

Nov. 27, 1991 [JP] Japan ..... 3-335892

[51] Int. Cl.[5] ..... G03C 1/46

[52] U.S. Cl. ..... 430/503; 430/558; 430/557; 430/384; 430/385

[58] Field of Search ..... 430/558, 384, 385, 503, 430/557

[56] References Cited

U.S. PATENT DOCUMENTS

| | | | |
|---|---|---|---|
| 4,910,127 | 3/1990 | Sakaki et al. | 430/546 |
| 4,992,360 | 2/1991 | Tsuruta et al. | 430/558 |
| 5,091,297 | 2/1992 | Fukunaga et al. | 430/385 |
| 5,256,526 | 10/1993 | Suzuki et al. | 430/385 |

FOREIGN PATENT DOCUMENTS

| | | |
|---|---|---|
| 0491197 | 6/1991 | European Pat. Off. . |
| 0488248 | 6/1992 | European Pat. Off. . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic light-sensitive material capable of providing a dye image having an improved spectral absorption characteristic, excellent color reproducibility and yet a sufficiently low minimum density, comprises a support having thereon a silver halide emulsion layer containing a yellow dye-forming coupler, a silver halide emulsion layer containing a magenta dye-forming coupler, and a silver halide emulsion layer containing a cyan dye-forming coupler, wherein the silver halide emulsion layer containing the cyan dye-forming coupler contains at least one cyan coupler represented by the following formula (I) or (II) and the silver halide emulsion layer containing the yellow dye-forming coupler contains at least one yellow coupler represented by the following formula (III):

(I)

(II)

With the substituents as defined herein the specification.

15 Claims, No Drawings

SILVER HALIDE COLOR PHOTOGRAPHIC LIGHT-SENSITIVE MATERIAL COMPRISING A PYRROLOTRIAZOLE CYAN COUPLER AND A SPECIFIC YELLOW COUPLER

FIELD OF THE INVENTION

The present invention relates to a silver halide color photographic light-sensitive material (hereinafter it may be simply referred to as a light-sensitive material), specifically to a light-sensitive material in which a dye image having an improved spectral absorption characteristic is formed, which results in leading to a light-sensitive material capable of providing a dye image having excellent color reproducibility in all hues and yet a sufficiently low minimum density.

BACKGROUND OF THE INVENTION

A silver halide color photographic light-sensitive material is subjected to an imagewise exposure and then to a development with an aromatic primary amine type color development agent to result in generating an oxidation product of the developing agent, which reacts with a dye-forming coupler (hereinafter referred to as a coupler) to thereby form a dye image. In the color photographic light-sensitive material, usually used as the coupler are a yellow dye-forming coupler, a cyan dye-forming coupler and a magenta dye-forming coupler in combination. The dyes formed by these couplers have undesired sub-absorptions in many cases, and in employing them for a multi-layer constitution silver halide color photographic light-sensitive material, the color reproducibility thereof is inclined to be deteriorated. Accordingly, to overcome these problems there have so far been proposed couplers which form an image having less sub-absorption and techniques of combining such couplers.

With respect to a magenta coupler, it is well known that a dye formed by a pyrazoloazole type magenta coupler has less sub-absorption, particularly in 420 to 450 nm, than a dye formed by a 5-pyrazolone type magenta coupler and provides a sharp visible absorption spectrum.

However, an improvement only in a magenta dye would be insufficient to reproduce well all colors of a subject by combining a cyan dye, a magenta dye and a yellow dye.

It is disclosed in JP-A-63-231451 (the term "JP-A" as used herewith means an unexamined Japanese patent application) that a specific yellow coupler is combined with a pyrazoloazole magenta coupler to try to improve color reproducibility in all hues.

The yellow coupler employed in JP-A-63-231451 is disclosed in JP-A-63-123047 as a yellow coupler which provides a dye showing a sharp absorption spectrum and has an excellent color developability and less fog as well as less fluctuation in color developability by pH of a color developing solution. However, the effects are insufficient with the combination described in JP-A-63-231451 and insufficient in terms of reduction of a minimum image density (Dmin) where the yellow coupler described in JP-A-63-231451 is used.

Further, the conventional phenol type and naphthol type couplers have unfavorable sub-absorptions in the yellow region of 400 to 430 nm, and accordingly have the serious problem that the color reproducibility is markedly reduced.

There are proposed as a means for solving this problem, cyan couplers such as pyrazoloazoles described in U.S. Pat. No. 4,873,183 and 2,4-diphenyimidazoles described in European Patent Publication 0249453A2. The dyes formed by these couplers have less unfavorable absorptions in a short wavelength region as compared with the dyes formed by the conventional cyan couplers and therefore are preferable in terms of color reproducibility. However, these couplers are not deemed to have enough color reproducibility and in addition, there still remain problems in actual use, such as a low coupling activity.

Further, pyrazoloimidazoles are proposed in U.S. Pat. No. 4,728,598. These couplers are improved in coupling activity, but are insufficient in terms of hue.

In recent years, further higher performances are requested to a color reproducibility and fastness of a dye image formed, and required from an overall point of view is a light-sensitive material capable of providing a dye image satisfying an excellent color reproducibility as a photographic image and having a reduced fog.

SUMMARY OF THE INVENTION

Accordingly, an object of the present invention is to provide a silver halide color photographic light-sensitive material capable of providing a dye image having an improved spectral absorption characteristic, an excellent color reproducibility and yet a sufficiently low minimum density.

To achieve the above and other objects, the present invention provides a silver halide color photographic light-sensitive material comprising a support having thereon a silver halide emulsion layer containing a yellow dye-forming coupler, a silver halide layer containing a magenta dye-forming coupler, and a silver halide emulsion layer containing a cyan dye-forming coupler, wherein the silver halide emulsion layer containing the cyan dye-forming coupler contains at least one cyan coupler represented by the following formula (I) or (II) and the silver halide emulsion layer containing the yellow dye-forming coupler contains at least one yellow coupler represented by the following formula (III):

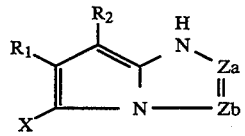

(I)

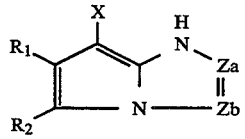

(II)

wherein Za and Zb each represents —C($R_3$)= or —N=, provided that one of Za and Zb is —N= and the other is —C($R_3$)=; $R_1$ and $R_2$ each represents an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; X represents a hydrogen atom or a group capable of splitting off upon a reaction with an oxidation product of an aromatic primary amine color developing agent; the group represented by $R_1$, $R_2$, $R_3$ or X may be a divalent group and combine with a polymer which is higher than a dimer and which has a high molecular weight chain to form a homopolymer or a copolymer;

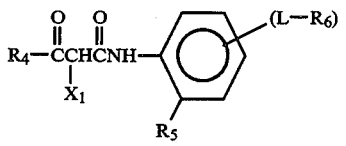

(III)

wherein $R_4$ represents an aryl group or a tertiary alkyl group; $R_5$ represents a fluorine atom, an alkyl group, an aryl group, an alkoxy group, an aryloxy group, a dialkylamino group, an alkylthio group, or an arylthio group; L represents —O—*, —COO—*, —NHCO—*, —NHCOCH$R_7$—*, —NHCO$(CH_2)_m$—*, —CONH—*, —CONH$(CH_2)_m$—*, —CONHCH$R_7$—*, —$SO_2NR_7(CH_2)_m$—*, —NH$SO_2$—*, or —NH$SO_2(CH_2)_m$—*; $R_7$ represents a hydrogen atom or an alkyl group; * represents the bonding direction to $R_6$; m represents an integer of 1 to 4; $R_6$ represents a halogen atom, an unsubstituted alkyl group, an unsubstituted aryl group, an unsubstituted alkoxy group, an unsubstituted aryloxy group, an alkyl-substituted aryl group, an alkoxy-substituted aryl group, an alkyl-substituted aryloxy group, or an aralkyloxy group; $X_1$ represents a hydrogen atom or a group capable of splitting off upon a reaction with an oxidation product of an aromatic primary amine color developing agent; and r represents an integer of 0 to 4, provided that when r is plural, each of the plural L—$R_6$ groups may be the same or different.

The present invention provides a silver halide color photographic light-sensitive material capable of forming a color image having excellent color reproducibility in all hues, a sufficiently low minimum density and a high fastness to light and heat.

DETAILED DESCRIPTION OF THE INVENTION

The present invention will be explained below in detail.

First, formulas (I) and (II) will be explained.

Za and Zb each represents —C($R_3$)= or —N=, provided that one of Za and Zb is —N= and the other is —C($R_3$)=.

That is, to be specific, the cyan couplers of the present invention are cyan dye forming couplers which are represented by the following formulas (I-a), (I-b), (II-a) and (II-b):

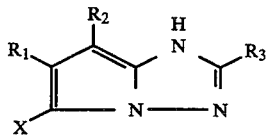

(I-a)

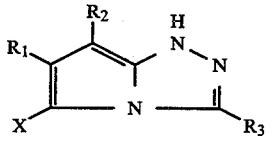

(I-b)

-continued

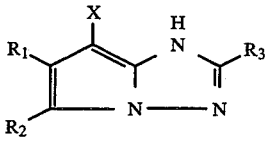

(II-a)

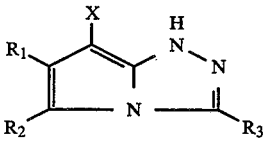

(II-b)

wherein $R_1$, $R_2$, $R_3$ and X have the same meanings as $R_1$, $R_2$, $R_3$ and X in formulas (I) and (II), respectively.

$R_3$ represents a hydrogen atom or a substituent, and there can be given as examples of the substituent, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, and an azolyl group. Of these substituents, the substituents other than a halogen atom, a cyano group, a hydroxy group, a nitro group, a carboxy group and a sulfo group may further be substituted with the substituents exemplified for $R_3$.

To be more specific, $R_3$ may represent a hydrogen atom, a halogen atom (for example, a chlorine atom and a bromine atom), an aliphatic group (which has preferably 1 to 32 carbon atoms and may be a linear or branched and saturated or unsaturated, for example, an alkyl group, an aralkyl group, an alkenyl group, a cycloalkyl group, and a cycloalkenyl group, with the alkyl group being preferred, to be in more detail, such as, methyl, ethyl, propyl, isopropyl, t-butyl, tridecyl, 2-methanesulfonylethyl, 3-(3-pentadecylphenoxy)propyl, 3-[4-{2-[4-(4-hydroxyphenylsulfonyl)phenoxy]-dodecanamide}phenyl]-propyl, 2-ethoxytridecyl, trifluoromethyl, cyclopentyl, and 3-(2,4-di-t-amylphenoxy)-propyl), an aryl group (having preferably 6 to 50 carbon atoms, for example, phenyl, 4-t-butylphenyl, 2,4-di-t-amylphenyl, and 4-tetradecanamidephenyl), a heterocyclic group (having preferably 1 to 50 carbon atoms, for example, 2-furyl, 2-thienyl, 2-pyrimidinyl, and 2-benzothiazolyl), a cyano group, a hydroxy group, a nitro group, a carboxy group, a sulfo group, an amino group, an alkoxy group (having preferably 1 to 50 carbon atoms, for example, methoxy, ethoxy, 2-methoxyethoxy, 2-dodecylethoxy, and 2-methanesulfonylethoxy), an aryloxy group (having preferably 6 to 50 carbon atoms, for example, phenoxy, 2-methylphenoxy, 4-t-butylphenoxy, 3-nitrophenoxy, 3-t-butyloxycarbamoylphenoxy, and 3-methoxycarbamoyl), an acylamino group (having preferably 2 to 50 carbon atoms, for example, acetamido, benzamido, tetradecanamido, 2-(2,4-di-t-amylphenoxy)butanamido, 4-(3-t-butyl-4-hydroxyphenoxy)butanamido, and 2-[4-(4-hydroxyphenylsulfonyl)phenoxy]decanamido), an alkylamino group (having preferably 1 to 50 carbon atoms, for example, methylamino, butylamino, dodecylamino, diethylamino, and methylbutylamino), an anilino group (having preferably 6 to 50 carbon atoms, for example, phenylamino, 2-chloroanilino, 2-chloro-5-tetradecanaminoanilino, 2-chloro-5-dodecyloxycarbonylanilino, N-acetylanilino, and 2-chloro-5-[2-(3-t-butyl-4-hydroxyphenoxy)dodecanamide]anilino), a ureido group (having preferably 2 to 50 carbon atoms, for example, phenylureido, methylureido, and N,N-dibutylureido), a sulfamoylamino group (having preferably 1 to 50 carbon atoms, for example, N,N-dipropylsulfamoylamino, and N-methyl-N-decylsulfamoylamino), an alkylthio group (having preferably 1 to 50 carbon atoms, for example, methylthio, octylthio, tetradecylthio, 2-phenoxyethylthio, 3-phenoxypropylthio, and 3-(4-t-butylphenoxy)propylthio), an arylthio group (having preferably 6 to 50 carbon atoms, for example, phenylthio, 2-butoxy-5-t-octylphenylthio, 3-pentadecylphenylthio, 2-carboxyphenylthio and 4-tetradecanamidephenylthio), an alkoxycarbonylamino group (having preferably 2 to 50 carbon atoms, for example, methoxycarbonylamino and tetradecyloxycarbonylamino), a sulfonamido group (having preferably 1 to 50 carbon atoms, for example, methanesulfonamido, hexadecanesulfonamido, benzenesulfonamido, p-toluenesulfonamido, octadecanesulfonamido, and 2-methoxy-5-t-butylbenzenesulfonamido), a carbamoyl group (having preferably 1 to 50 carbon atoms, for example, N-ethylcarbamoyl, N,N-dibutylcarbamoyl, N-(2-dodecyloxyethyl)-carbamoyl, N-methyl-N-dodecylcarbamoyl, and N-[3-(2,4-di-t-amylphenoxy)-propyl]carbamoyl), a sulfamoyl group (having preferably 0 to 50 carbon atoms, for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a sulfonyl group (having preferably 1 to 50 carbon atoms, for example, methanesulfonyl, octanesulfonyl, benzenesulfonyl, and toluenesulfonyl), an alkoxycarbonyl group (having preferably 2 to 50 carbon atoms, for example, methoxycarbonyl, butyloxycarbonyl, dodecyloxycarbonyl, and octadecyloxycarbonyl), a heterocyclic oxy group (having preferably 1 to 50 carbon atoms, for example, 1-phenyltetrazole-5-oxy, and 2-tetrahydropyranyloxy), an azo group (having preferably 6 to 50 carbon atoms, for example, phenylazo, 4-methoxyphenylazo, 4-pivaloylaminophenylazo, and 2-hydroxy-4-propanoylphenylazo), an acyloxy group (having preferably 2 to 50 carbon atoms, for example, acetoxy), a carbamoyloxy group (having preferably 2 to 50 carbon atoms, for example, N-methylcarbamoyloxy and N-phenylcarbamoyloxy), a silyloxy group (having preferably 3 to 50 carbon atoms, for example, trimethylsilyloxy and dibutylmethylsilyloxy), an aryloxycarbonylamino group (having preferably 7 to 50 carbon atoms, for example, phenoxycarbonylamino), an imido group (having preferably 1 to 40 carbon atoms, for example, N-succinimido, N-phthalimido, and 3-octadecenylsuccinimido), a heterocyclic thio group (having preferably 1 to 50 carbon atoms, for example, 2-benzothiazolylthio, 2,4-diphenoxy-1,3,5-triazole-6-thio, and 2-pyridylthio), a sulfinyl group (having preferably 1 to 50 carbon atoms, for example, dodecanesulfinyl, 3-pentadecylphenylsulfinyl, and 3-phenoxypropylsulfinyl), a phosphonyl group (having preferably 1 to 50 carbon atoms, for example, phenoxyphosphonyl, octyloxyphosphonyl, and phenylphosphonyl), an aryloxycarbonyl group (having preferably 7 to 50 carbon atoms, for example, phenoxycarbonyl), an acyl group (having preferably 2 to 50 carbon atoms, for example, acetyl, 3-phenylpropanoyl, benzoyl, and 4-dodecyloxybenzoyl), and an azolyl group (having preferably 1 to 50 carbon atoms, for example, imidazolyl, pyrazolyl, 3-chloropyrazole-1-yl, and triazolyl).

There can be preferably given as examples of $R_3$, an alkyl group, an aryl group, a heterocyclic group, a cyano group, a nitro group, an acylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an acyloxy group, a carbamoyloxy group, an aryloxycarbonylamino group, an imido group, a heterocyclic thio group, a sulfinyl group, a phosphonyl group, an aryloxycarbonyl group, an acyl group, and an azolyl group.

$R_3$ is further preferably an alkyl group or an aryl group. It is more preferably an alkyl group or aryl group having at least one substituent which provides a flocculation property, and further preferably an alkyl group or aryl group each having at least one alkoxy group, sulfonyl group, sulfamoyl group, carbamoyl group, acylamido group, or sulfonamido group as a substituent. It is particularly preferably an alkyl group or aryl group each having at least one acylamido group or sulfonamido group as a substituent. These substituents when substituted on an aryl group are more preferably substituted at least at an ortho position.

In the cyan coupler of the present invention, $R_1$ and $R_2$ each are an electron attractive groups having a $\sigma_p$ value of 0.2 or more, and a value of 0.65 or more in the total of the $\sigma_p$ values of $R_1$ and $R_2$ makes it possible to develop a color to form a cyan dye image. The total of the $\sigma_p$ values of $R_1$ and $R_2$ is preferably 0.70 or more and the upper limit thereof is not much more than 1.8.

$R_1$ and $R_2$ each are an electron attractive group having a Hammett's substituent constant $\sigma_p$ of 0.20 or more, preferably 0.30 or more. The upper limit thereof is 1.0 or less. The Hammett's rule is an empirical rule which was proposed by L. P. Hammett in 1935 in order to quantitatively asses the affects exerted by a substituent on a reaction or equilibrium of a benzene derivative. In these days, the propriety thereof is widely accepted.

The $\sigma_p$ value and $\sigma_m$ value are available as the substituent constant obtained according to the Hammett's rule and the values thereof are described in many publications. They are described in, for example, *Lange's Handbook of Chemistry*, Vol. 12, edited by J. A. Dean, 1979 (McGrow-Hill) and *Chemical Region No.* 122, pp. 96 to 103, 1979 (Nankohdo). In the present invention, $R_1$ and $R_2$ are determined by reference to the Hammett's substituent constant $\sigma_p$ value, but this does not mean that they are limited to the substituents the $\sigma_p$ values of which are described in these publications. Even if the $\sigma_p$ value of a particular group is not described in the publications, the particular group is naturally included in the scope of the present invention as long as it satisfies the above Hammett's substituent range when it is measured according to Hammett's rule.

There can be given as specific examples of groups represented by $R_1$ and $R_2$ which are the electron attractive groups having $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having a $\sigma_p$ of 0.20 or more, a heterocyclic group, a halogen atom, an azo group, and a selenocyanato group. Of these substituents, groups capable of further having substituents may further have the substituents exemplified for $R_3$.

To explain $R_1$ and $R_2$ in more detail, there can be given as specific examples of the electron attractive groups having $\sigma_p$ values of 0.20 or more, an acyl group (having preferably 1 to 50 carbon atoms, for example, acetyl, 3-phenylpropanoyl, benzoyl, and 4-dodecyloxybenzoyl), an acyloxy group (for example acetoxy), a carbamoyl group (having preferably 0 to 50 carbon atoms, for example, carbamoyl, N-ethylcarbamoyl, N-phenylcarbamoyl, N,N-dibutylcarbamoyl, N-(2-dodecyloxyethyl)carbamoyl, N-(4-n-pentadecanamide)phenylcarbamoyl, N-methyl-N-dodecylcarbamoyl, and N-[3-(2,4-di-t-amylphenoxy)propyl]carbamoyl), an alkoxycarbonyl group (having preferably 2 to 50 carbon atoms, for example, methoxycarbonyl, ethoxycarbonyl, isopropyloxycarbonyl, tert-butyloxycarbonyl, isobutyloxycarbonyl, butyloxycarbonyl, dodecyloxycarbonyl, and octadodecyloxycarbonyl), an aryloxycarbonyl group (having preferably 7 to 50 carbon atoms, for example, phenoxycarbonyl), a cyano group, a nitro group, a dialkylphosphono group (having preferably 2 to 50 carbon atoms, for example, dimethylphosphono), a diarylphosphono group (having preferably 12 to 60 carbon atoms, for example, diphenylphosphono), a diarylphosphinyl group (having preferably 12 to 60 carbon atoms, for example, diphenylphosphinyl), an alkylsulfinyl group (having preferably 1 to 50 carbon atoms, for example, 3-phenoxypropylsulfinyl), an arylsulfinyl group (having preferably 6 to 50 carbon atoms, for example, 3-pentadecylphenylsulfinyl), an alkylsulfonyl group (having preferably 1 to 50 carbon atoms, for example, methanesulfonyl and octanesulfonyl), an arylsulfonyl group (having preferably 6 to 50 carbon atoms, for example, benzenesulfonyl and toluenesulfonyl), a sulfonyloxy group (having preferably 1 to 50 carbon atoms, for example, methanesulfonyloxy and toluenesulfonyloxy), an acylthio group (having preferably 1 to 50 carbon atoms, for example, acetylthio and benzoylthio), a sulfamoyl group (having preferably 0 to 50 carbon atoms, for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a thiocyanate group, a thiocarbonyl group (having preferably 2 to 50 carbon atoms, for example, methylthiocarbonyl and phenylthiocarbonyl), a halogenated alkyl group (having preferably 1 to 20 carbon atoms, for example, trifluoromethane and heptafluoropropane), a halogenated alkoxy group (having preferably 1 to 20 carbon atoms, for example, trifluoromethyloxy), a halogenated aryloxy group (having preferably 6 to 12 carbon atoms, for example, pentafluorophenyloxy), a halogenated alkylamino group (having preferably 1 to 20 carbon atoms, for example, N,N-di-(trifluoromethyl-)amino), a halogenated alkylthio group (having preferably 1 to 20 carbon atoms, for example, difluoromethyl and 1,1,2,2-tetrafluoroethylthio), an aryl group substituted with an electron attractive group having a $\sigma_p$ of 0.20 or more (having preferably 6 to 20 carbon atoms, for example, 2,4-dinitrophenyl, 2,4,6-trichlorophenyl, and pentachlorophenyl), a heterocyclic group (having preferably 0 to 40 carbon atoms, for example, 2-benzoxazolyl, 2-benzo-thiazolyl, 1-phenyl-2-benzimidazolyl, 5-chloro-1-tetrazolyl, and 1-pyrrolyl), a halogen atom (for example, a chlorine atom and a bromine atom), an azo group (having preferably 6 to 40 carbon atoms, for example, phenylazo), and a selenocyanato group. Of these substituents, groups capable of further having substituents may further have the substituents given for the groups defined for $R_3$.

There can be given as the preferable substituents represented by $R_1$ and $R_2$, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, an aryl group substituted with an electron attractive group having a $\sigma_p$ of 0.20 or more, and a heterocyclic group. Further preferred are an alkoxycarbonyl group, a nitro group, a cyano group, an arylsulfonyl group, a carbamoyl group, a halogenated alkyl group, and an aryloxycarbonyl group.

Most preferred as $R_1$ is a cyano group. Particularly preferred as $R_2$ is an alkoxycarbonyl group and most preferred is a branched alkoxycarbonyl group.

X represents a hydrogen atom or a group capable of splitting off by a coupling reaction with an oxidation product of an aromatic primary amine color developing agent. To explain the group capable of splitting off in detail, there can be given as examples, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitrogen-containing heterocyclic group, an imido group, and an arylazo group. These groups may further be substituted with the groups exemplified for $R_3$.

To be more specific, there can be given as suitable examples of X, a halogen atom (for example, a fluorine atom, a chlorine atom and a bromine atom), an alkoxy group (having preferably 1 to 50 carbon atoms, for example, ethoxy, dodecyloxy, methoxyethylcarbamoylmethoxy, carboxypropyloxy, methylsulfonylethoxy, and ethoxycarbonylmethoxy), an aryloxy group (having preferably 6 to 50 carbon atoms, for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (having preferably 2 to 50 carbon atoms, for example, acetoxy, tetradecanoyloxy, and benzolyoxy), an alkyl- or arylsulfonyloxy group (having preferably 1 to 50 carbon atoms, for example, methanesulfonyloxy and toluenesulfonyloxy), an acylamino group (having preferably 2 to 50 carbon atoms, for example, dicholoroacetylamino and heptafluorobutylylamino), an alkyl- or arylsulfonamido group (having preferably 1 to 50 carbon atoms, for example, methanesulfonamido, trifluoromethanesulfonamido, and p-tolunesulfonylamino), an alkoxycarbonyloxy group (having preferably 2 to 50 carbon atoms, for example, ethoxycarbonyloxy and benzyloxycarbonyloxy), an aryloxycarbonyloxy group (having preferably 7 to 50 carbon atoms, for example, phenoxycarbonyloxy), an alkyl-, aryl- or heterocyclicthio group (having preferably 1 to 50 carbon atoms, for example, dodecylthio, 1-carboxydodecylthio, phenylthio, 2-butoxy-5-t-octylphenylthio, and tetrazolylthio), a carbamoylamino group (having preferably 2 to 50 carbon atoms, for example, N-methylcarbamoylamino and N-phenylcarbamoylamino), a 5-membered or 6-membered nitrogen-containing heterocyclic group (having preferably 1 to 50 carbon atoms, for example, imidazolyl, pyrazolyl, triazolyl, tetrazolyl, and, 2-dihydro-2-oxo-1-pyridyl), an imido group (having preferably 1 to 50 carbon atoms, for example, succinimido and hydantoinyl), and an arylazo group (having preferably 6 to 40 carbon atoms, for example, phenylazo and 4-methoxyphenylazo). In addition to the above groups, X may take, as a splitting group having a bond via a carbon atom, a bis type coupler form obtained by condensing a 4-equivalent coupler with aldehydes and ketones described, for example, in *The Theory of the Photographic Process* by T. H. James, 4th Ed., (Macmillan Publishing Co., Inc.), Ch. 12, sec. III.C. pp. 356–358 or No. 4.20 of *Paper from ICPS* '82 (International Congress of Photographic Science, University of Cambridge, Sept. 6–10, 1982, The Royal Phot. Sci. of Great Britain). Further, X may contain a photographically useful group, such as a development inhibitor and a development accelerator described in *Research Disclosure*, No. 307105, VII, Item F.

X is preferably a halogen atom, an alkoxy group, an aryloxy group, an alkyl or arylthio group, or a 5-membered or 6-membered nitrogen-containing heterocyclic group bonded to a coupling active site via the nitrogen atom. X is more preferably a halogen atom, or an alky- or arylthio group. Particularly preferred is an arylthio group.

In the cyan coupler represented by formula (I) or (II), the group represented by $R_1$, $R_2$, $R_3$ or X may be a divalent group resulting from the removal of one hydrogen atom from a monovalent group thereof, and form a dimer or a polymer which is higher than a dimer or combine with a high molecular weight chain to form a homopolymer or a copolymer. A typical example of a homopolymer or copolymer formed by combining with a high molecular chain is a homopolymer or copolymer of an addition polymer ethylene type unsaturated compound having a cyan coupler group represented by formula (I) or (II). In this case, two or more kinds of a cyan color development recurring unit having the cyan coupler group represented by formula (I) or (II) may be contained in the polymer and one or more kinds of a non-color developable ethylene type monomer may be contained therein as a copolymerization component. The cyan color development recurring unit having the cyan coupler group represented by formula (I) or (II) is represented preferably by the following formula (P):

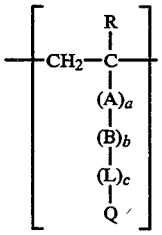

(P)

wherein R represents a hydrogen atom, an alkyl group having 1 to 4 carbon atoms, or a chlorine atom; A represents —CONH—, —COO—, or a substituted or unsubstituted phenylene group; B represents a substituted or unsubstituted alkylene group, phenylene group or alkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represent 0 and 1; and Q represents a cyan coupler group formed by making a hydrogen atom split off from $R_1$, $R_2$, $R_3$ or X in the compound represented by formula (I) or (II).

Preferred as the polymer is the copolymer of a cyan color developing monomer represented by a coupler unit of formula (I) or (II) and a non-color developable ethylene type monomer which is not capable of coupling with an oxidation product of an aromatic primary amine developing agent.

There are available as the non-color developable ethylene type monomer which is not capable of coupling with an oxidation product of an aromatic primary amine developing agent, acrylic acid, α-chloroacrylic acid, α-alkylacrylic acid (for example, methacrylic acid), an amide or ester derived from these acrylic acids (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), a vinyl ester (for example, vinyl acetate, vinyl propionate, and vinyl laurate), acrylonitrile, methacrylonitrile, an aromatic vinyl compound (for example, styrene and derivatives thereof, for example, vinyltoluene, divinylbenzene, vinylacetophenone, and sulfostyrene), itaconic acid, citraconic acid, crotonic acid, vinylidene chloride, vinylalkyl ether (for example, vinylethyl ether), maleic acid ester, N-vinyl-2-pyrrolidone, N-vinylpyridine, 2-vinylpyridine and 4-vinylpyridine.

Particularly preferred are acrylic acid ester, methacrylic acid ester, and maleic acid ester. The non-color developable ethylene type monomer used herewith can be used in combination of two or more kinds of monomers. For example, there can be used methyl methyacrylate and butyl acrylate, butyl acrylate and styrene, butyl methacrylate and methacrylic acid, and methyl acrylate and diacetone acrylamide.

As known in the art of polymer couplers, the ethylene type unsaturated monomer which can be copolymerized with the vinyl type monomer (P) corresponding to the compound represented by formula (I) or (II) can be selected so that the physical properties and/or chemical properties of the copolymer formed, for example, solubility, compatibility with a binder for a photographic colloid composition, such as gelatin, and flexibility and thermal stability thereof, are favorably affected.

In order to incorporate the cyan coupler of the present invention into a silver halide light-sensitive material, preferably a red-sensitive silver halide emulsion layer, it is converted preferably to a non-diffusible type coupler. For meeting this purpose, at least one of the groups represented by $R_1$, $R_2$, $R_3$ and X is preferably a so-called ballast group (preferably having 10 or more total carbon atoms, more preferably 10 to 50 total carbon atoms). In particular, $R_3$ is preferably the ballast group.

In the present invention, the cyan coupler represented by formula (I), particularly the cyan coupler represented by formula (I-a), is preferred in terms of the effect thereof.
Specific examples of the cyan couplers of the present invention are shown below as Compounds C-1 to C-60, but the present invention is not limited thereto.
C-1
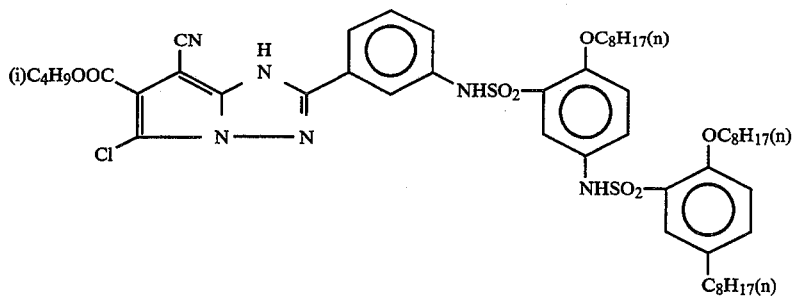
C-2
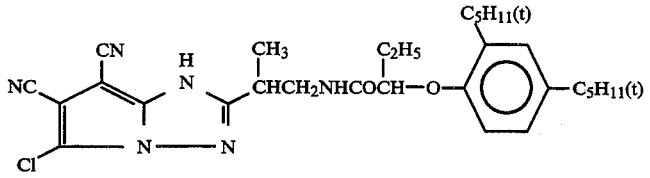
C-3
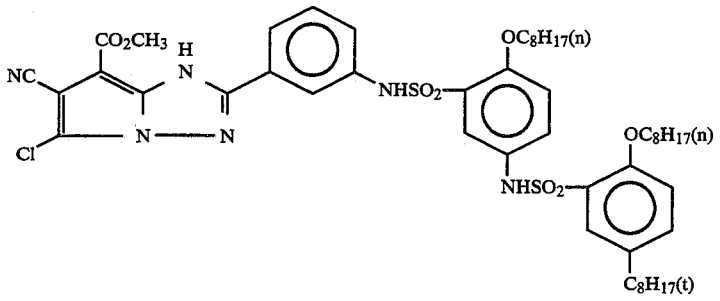
C-4
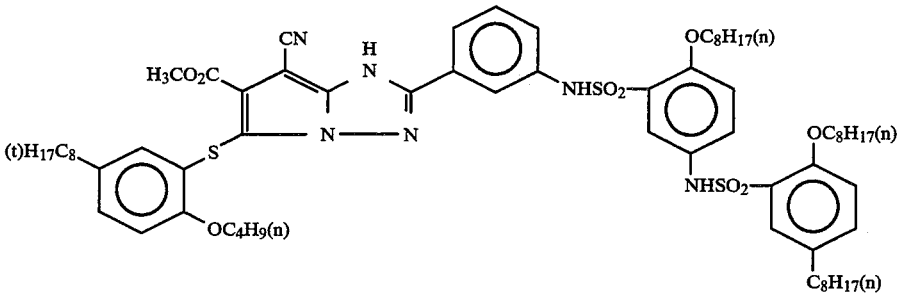
C-5
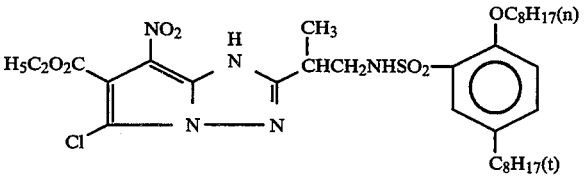
C-6
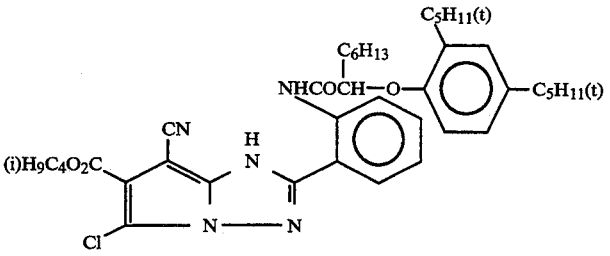

-continued
C-7
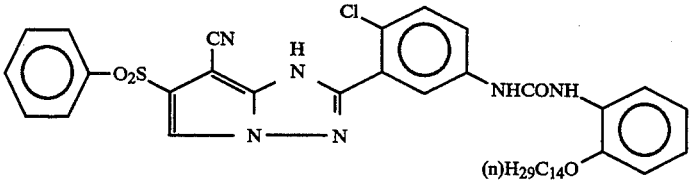
C-8
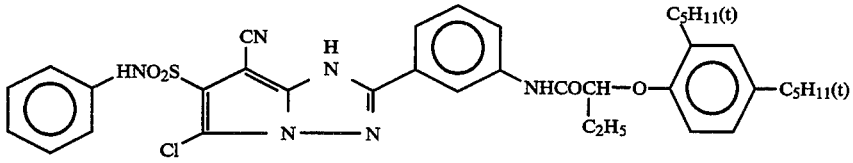
C-9
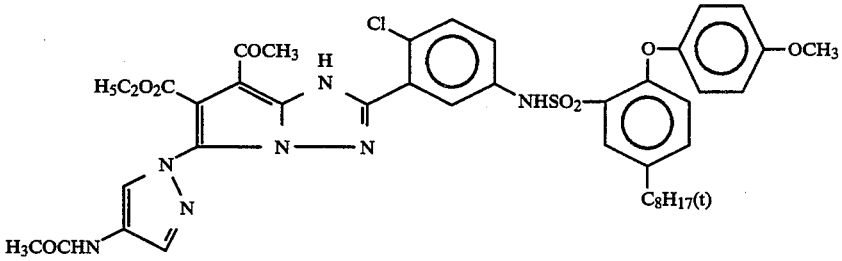
C-10
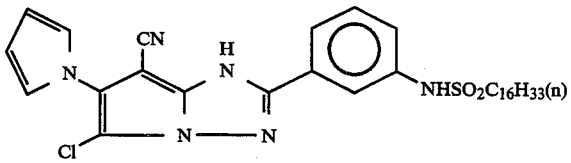
C-11
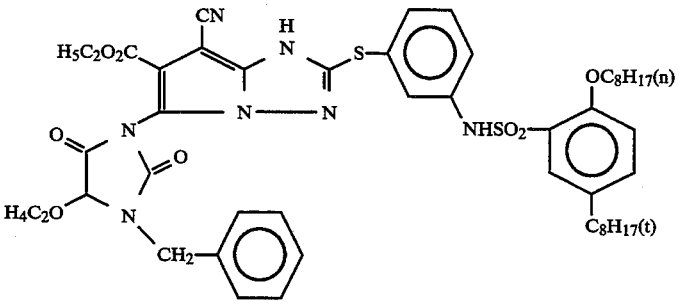
C-12
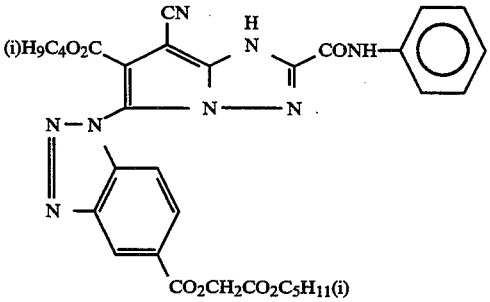
C-13
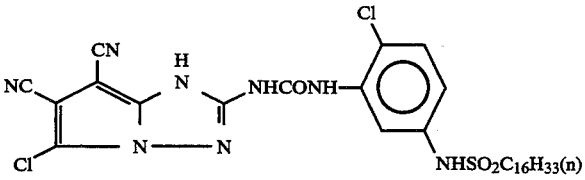

-continued
C-14
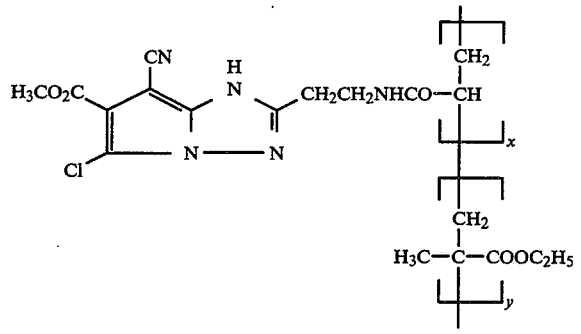
X:Y = 50:50
(mole ratio)
C-15
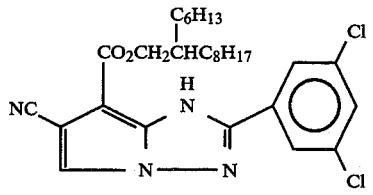
C-16
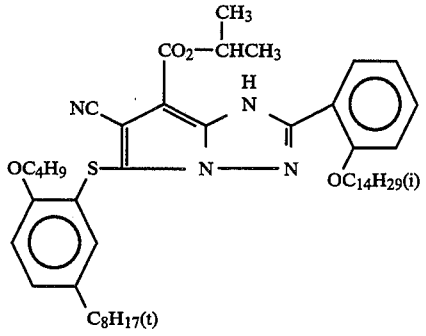
C-17
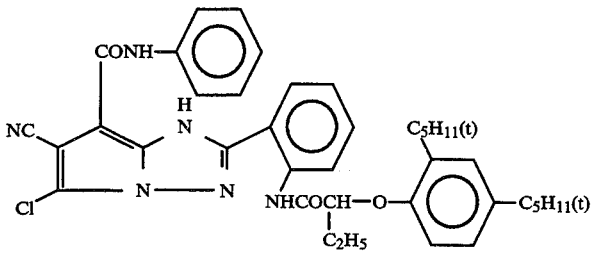
C-18
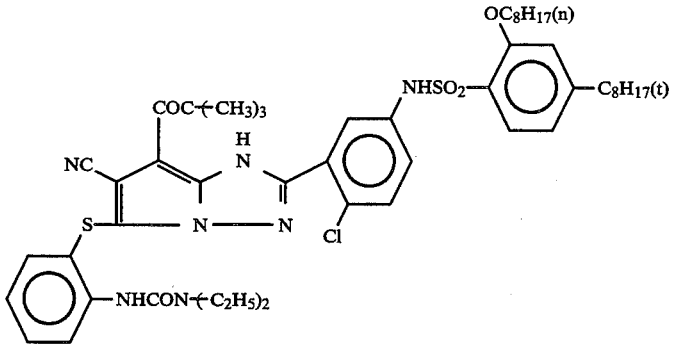

-continued
C-19
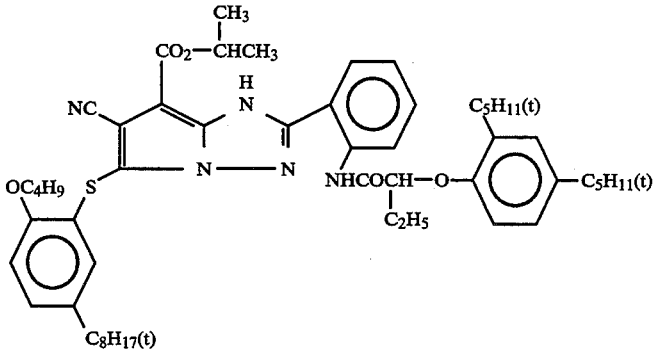
C-20
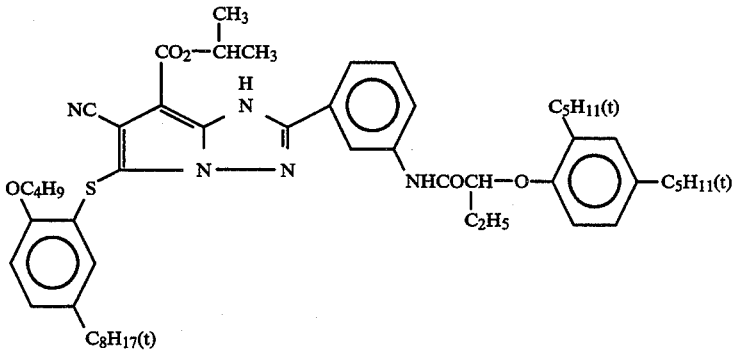
C-21
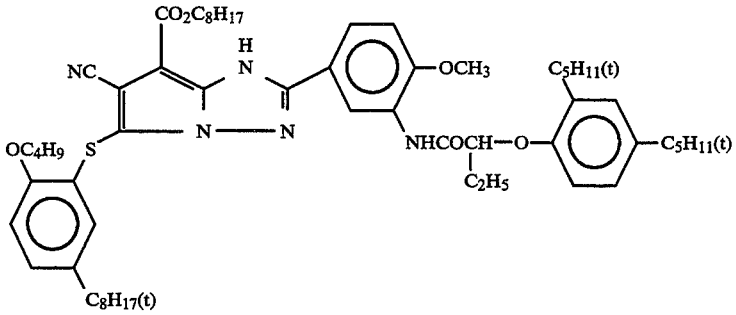
C-22
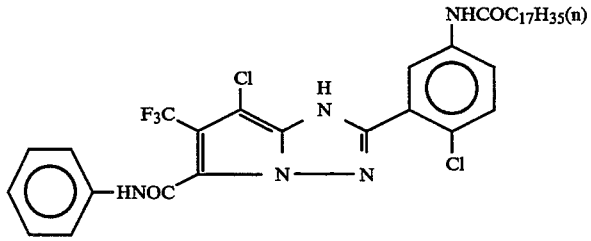
C-23
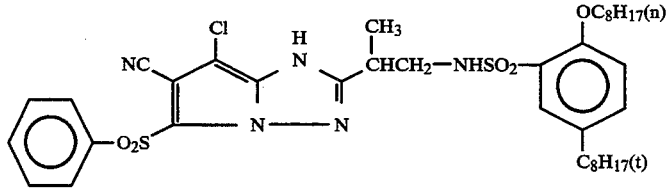
C-24
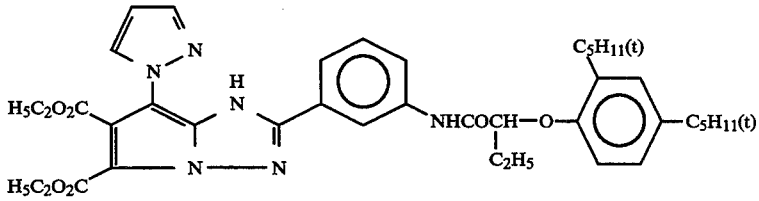

-continued
C-25
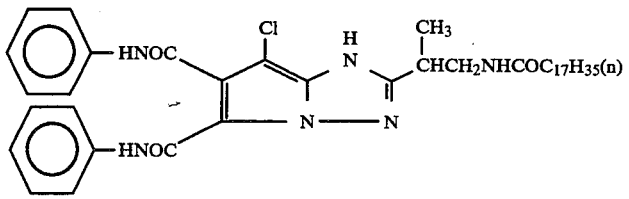
C-26
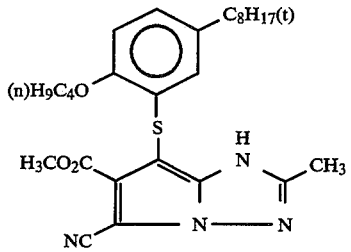
C-27
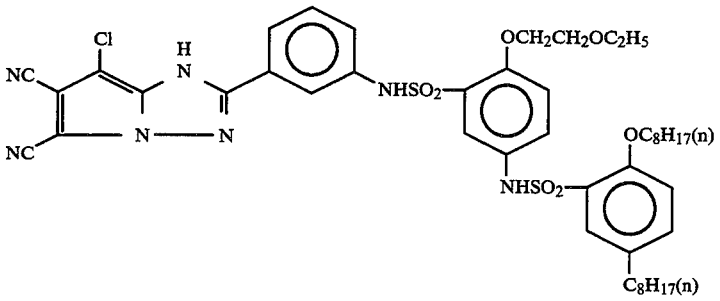
C-28
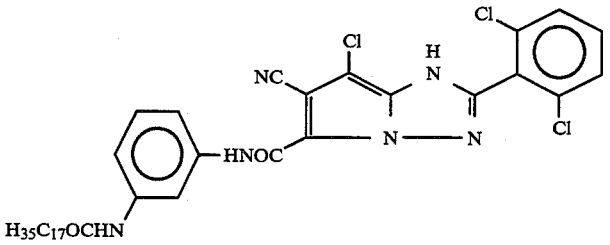
C-29
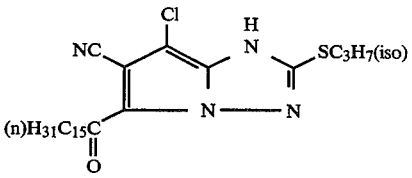
C-30
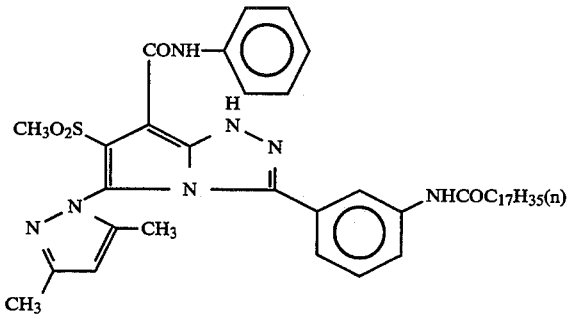

-continued
C-31
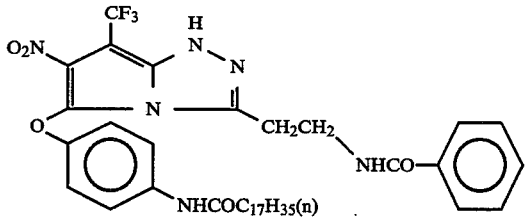
C-32
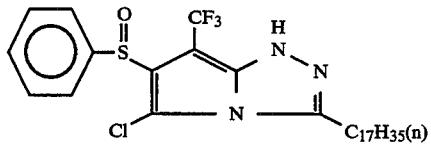
C-33
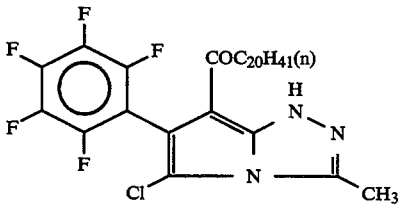
C-34
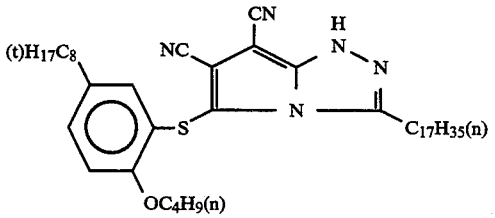
C-35
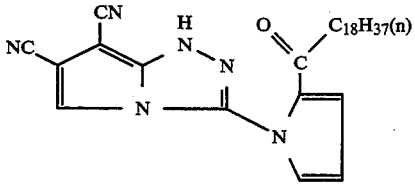
C-36
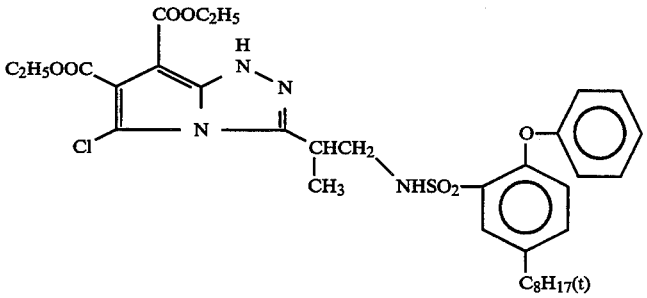
C-37
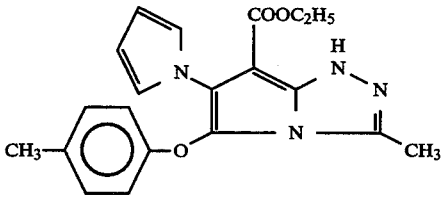

-continued
C-38
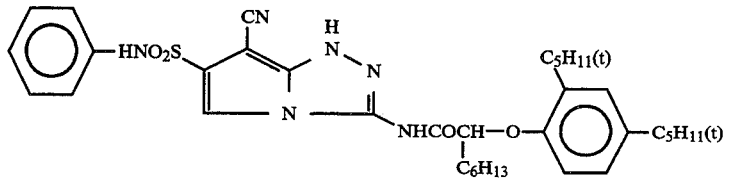
C-39
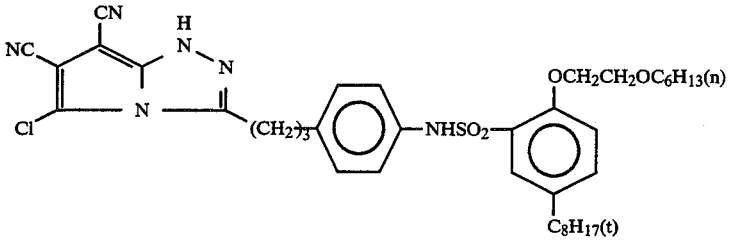
C-40
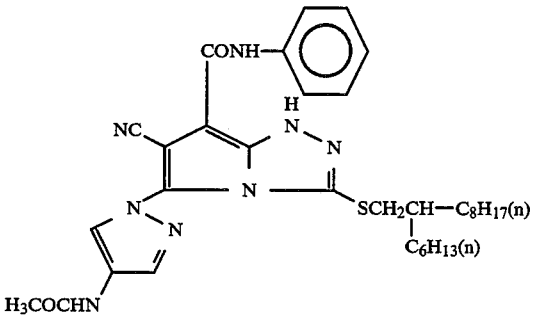
C-41
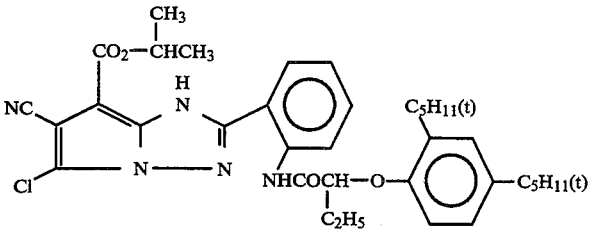
C-42
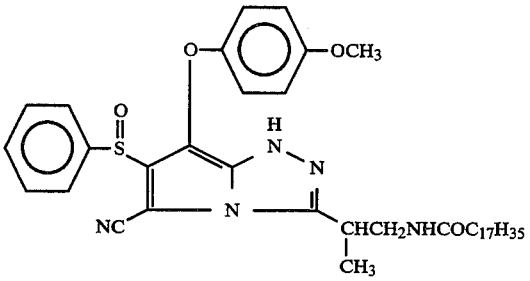
C-43
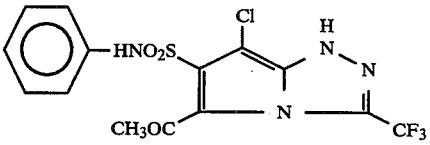
C-44
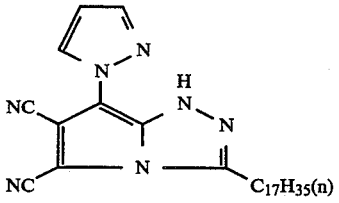

-continued
C-45
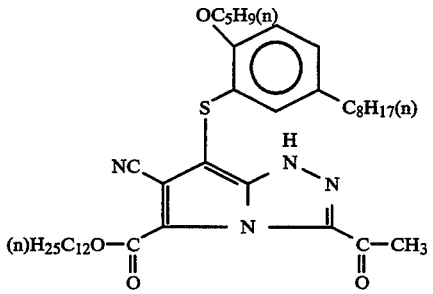
C-46
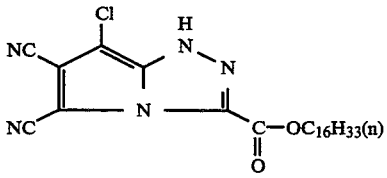
C-47
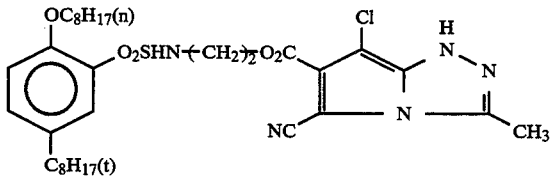
C-48
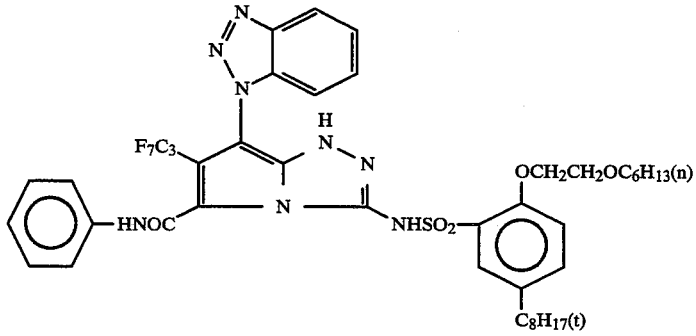
C-49
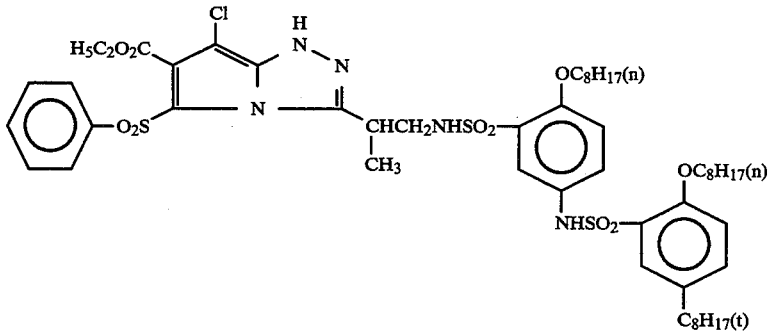

-continued
C-50
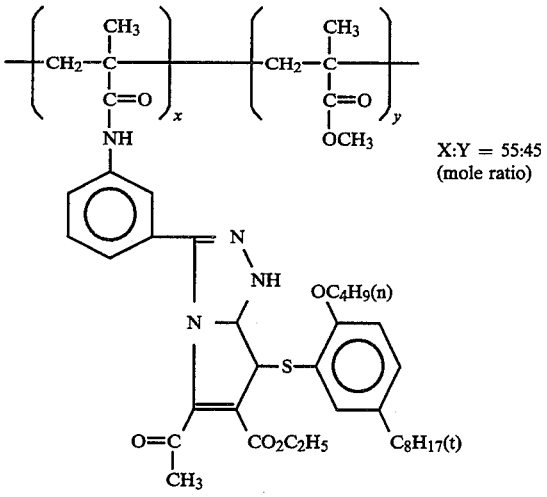
X:Y = 55:45
(mole ratio)
C-51
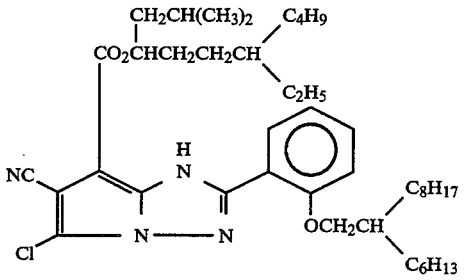
C-52
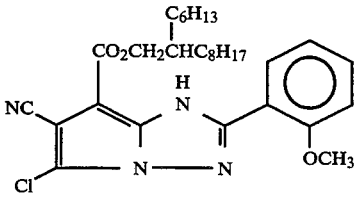
C-53
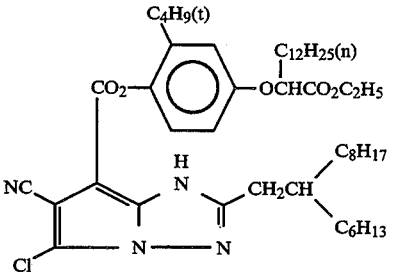
C-54
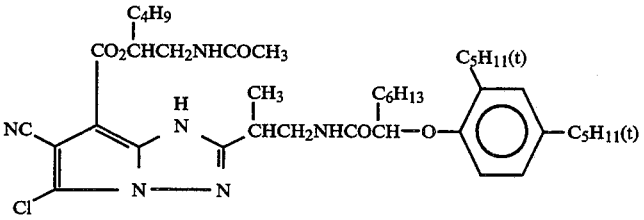

-continued
C-55
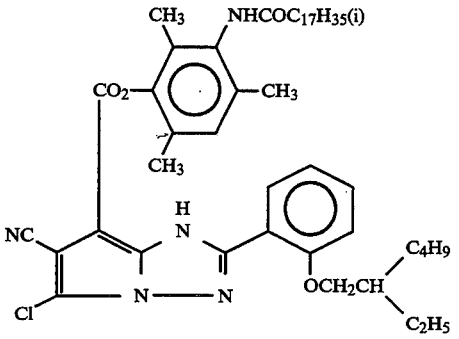
C-56
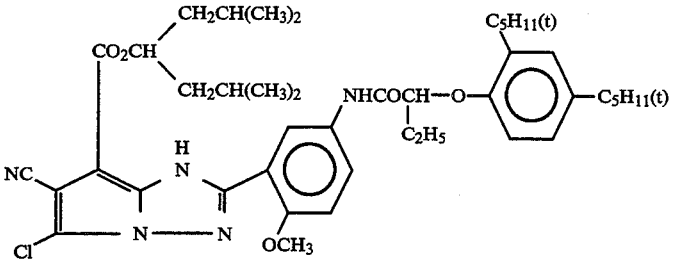
C-57
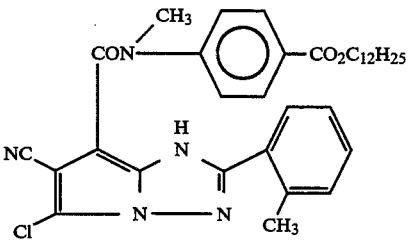
C-58
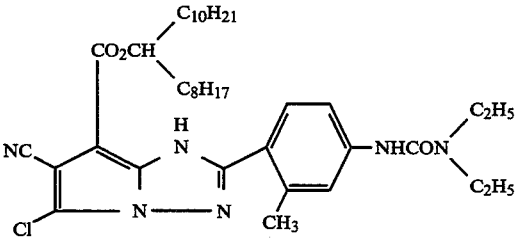
C-59
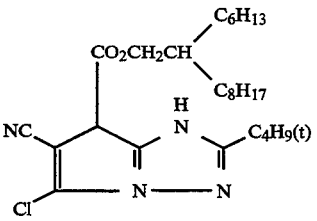
C-60
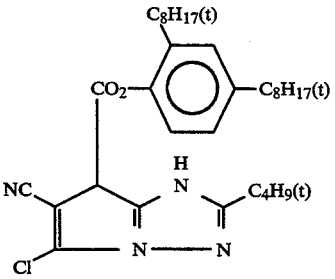
Next, synthesis examples of the cyan couplers of the present invention will be shown in order to explain the synthesis thereof.

Synthesis of Compound C-1

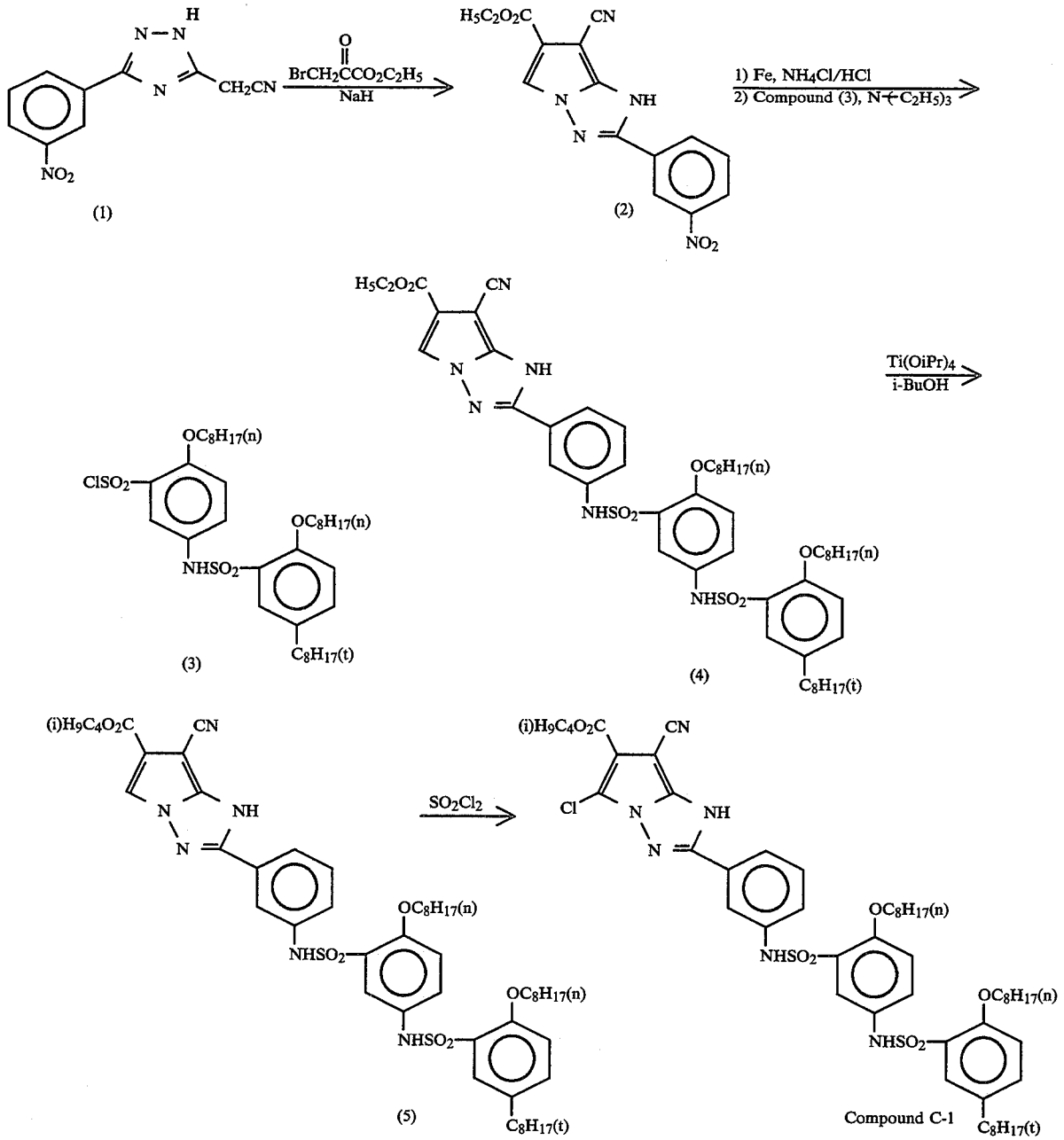

There was dissolved 3-m-nitrophenyl-5-methylcyano-1,2,4-triazole (compound (1)) (20.0 g, 87.3 mmol) in dimethylacetamide (150 ml), and NaH (60% by weight in oil) (7.3 g, 183 mmol) was added thereto little by little, followed by heating to 80° C. A dimethylacetamide solution (50 ml) of ethyl bromopiruvate (13.1 ml, 105 mmol) was slowly added dropwise to the above solution. The resulting reaction solution was stirred at 80° C. for 30 minutes after the dropwise addition was completed, and then was cooled down to room temperature. Hydrochloric acid 1N then was added to the cooled reaction solution to make it acid, and then the solution was extracted with ethyl acetate. After drying on sodium sulfate, the solvent was distilled off under a reduced pressure. The residue was refined by silica gel chromatography, whereby the compound (2) (10.79 g) (yield: 38%) was obtained.

Reduced iron (9.26 g, 166 mmol) and ammonium chloride (0.89 g, 16.6 mmol) were suspended in isopropanol (300 ml) and then, water (30 ml) and concentrated hydrochloric acid (2 ml) were further added and the solution was heated at refluxing for 30 minutes. Compound (2) (10.79 g, 33.2 mmol) was added little by little while heating at refluxing. After heating at refluxing for a further 4 hours, the solution was immediately filtered with celite and the filtrate was subjected to a distillation under a reduced pressure. The residue was dissolved in a mixed solvent of dimethylacetamide (40 ml) and ethyl acetate (60 ml) and compound (3) (25.6 g, 36.5 mmol) was added thereto. Then, triethylamine (23.1 ml, 166 mmol) was added and the solution was heated at 70° C. for 5 hours. After the reaction solution was cooled down to room temperature, water was added thereto and the solution was extracted with ethyl acetate. After the extract was washed with water, it was dried on sodium sulfate and the solvent was distilled off under a reduced pressure. The residue was refined by silica gel chromatography, whereby compound (4) (16.5 g) (yield 52%) was obtained.

Compound (4) (7.0 g, 7.30 mmol) was dissolved in isobutanol (14 ml) and tetraisopropyl orthotitanate (0.43 ml, 1.46 mmol) was added, followed by heating for refluxing at 6 hours. After the reaction solution was cooled down to room temperature, water was added thereto and the solution was extracted with ethyl acetate. The extract was dried on sodium sulfate and the solvent was distilled off under a reduced pressure. The residue was refined by silica gel chromatography, whereby compound (5) (5.0 g) (yield 69%) was obtained.

Compound (5) (5.0 g, 5.04 mmol) was dissolved in tetrahydrofuran (50 ml), and $SO_2Cl_2$ (0.40 ml, 5.04 mmol) was added dropwise while cooling with water. After the dropwise addition was completed, the solution was stirred for a further 4 hours while cooling with water. Water was added to the reaction solution and the solution was extracted with ethyl acetate. The extract was dried on sodium sulfate and the solvent was distilled off under a reduced pressure. The residue was refined by silica gel chromatography, whereby the Compound C-1 (3.9 g) (yield: 76%) was obtained.

SYNTHESIS EXAMPLE 2

Synthesis of Compound C-39

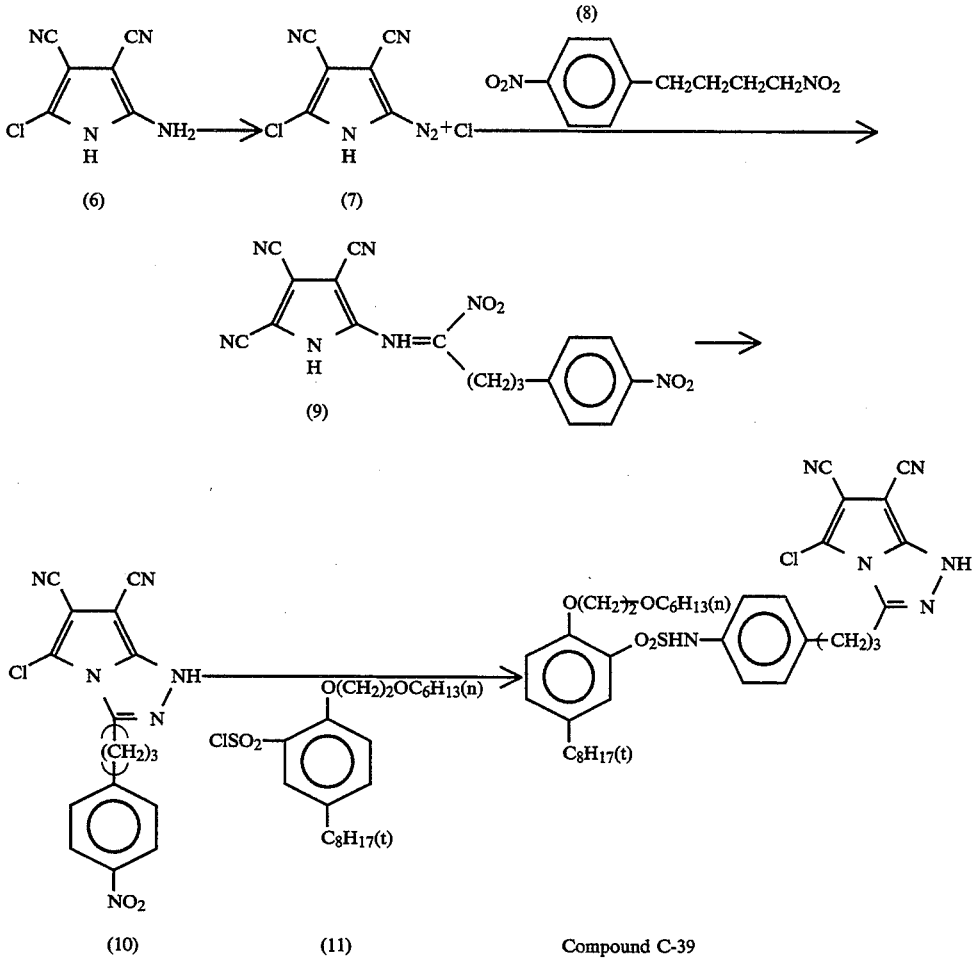

Hydrochloric acid (36%) (38 ml) was added to 2-amino-5-chloro-3,4-dicyanopyrrole (compound (6)) (6.78 g, 40.7 mmol), and an aqueous solution (5.9 ml) of sodium nitrite (2.95 g, 42.7 mmol) was slowly added dropwise while stirring and cooling with ice, followed by continuing stirring for a further 1.5 hours, whereby compound (7) was prepared. While stirring and cooling with ice, the solution of compound (7) prepared above was slowly added dropwise to a solution prepared by adding sodium methylate (28%) (102 ml) to an ethanol solution (177 ml) of compound (8) (9.58 g, 427 mmol) while stirring and cooling with ice, and then stirring was continued for 1 hour. Next, the resulting reaction solution was heated at refluxing for 1.5 hours. Then, ethanol was distilled off from the reaction solution under a reduced pressure, and the residue was dissolved in chloroform. The solution thus prepared was washed with a saturated brine, and after drying on sodium sulfate, chloroform was distilled off under a reduced pressure. The residue was refined by silica gel chromatography to thereby obtain compound (10) (4.19 g) (the yield from compounds (6) through (10): 29%).

Compound (6) was synthesized as illustrated below by subjecting 3,4-dicyanopyrrole to a nitration and a reduction with iron after chlorination. Also, compound (8) was synthesized from compound (a) synthesized from γ-lactone and benzene by a known method, according to the method described in *Journal of the American Chemical Society*, 76, pp. 3209 (1954).

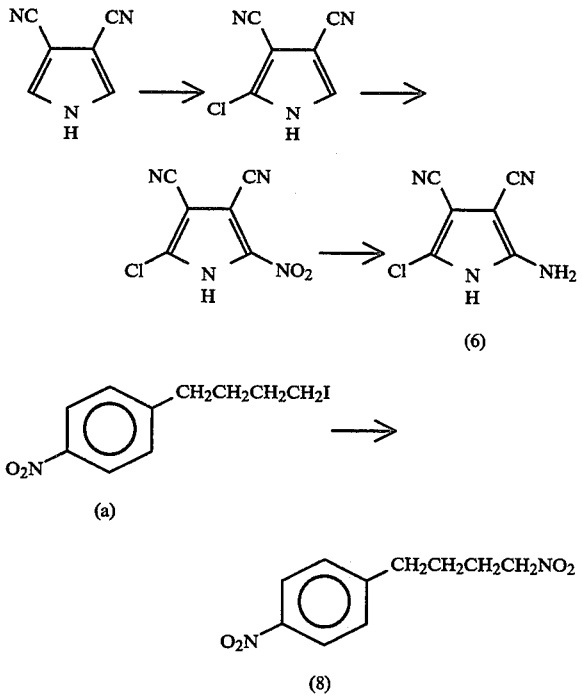

Water (10 ml), ammonium chloride (0.3 g, 5.9 mmol) and acetic acid (0.34 ml, 5.9 mmol) were added to reduced iron powder (3.3 g, 59.0 mmol), and the solution thus prepared was heated at refluxing for 15 minutes while stirring. Then, isopropanol (31 ml) was added thereto and the solution was heated at refluxing for a further 20 minutes while stirring. Next, an isopropanol solution (14 ml) of compound (10) (4.1 g, 11.8 mmol) was added dropwise and the resulting reaction solution was heated at refluxing for 2 hours. Then, the reaction solution was filtered using celite as a filter aid and the the residue was washed with ethyl acetate, followed by distilling the solution under a reduced pressure.

The residue was dissolved in a mixed solvent of ethyl acetate (16 ml) and dimethylacetamide (24 ml). There were added thereto compound (11) (5.6 g, 13.0 mmol) and then triethylamine (8.2 ml, 59.0 mmol), and the solution was stirred at room temperature for 4 hours. Water was added thereto and the solution was extracted with ethyl acetate, followed by washing the extract with a saturated brine. After drying on sodium sulfate, the solvent was distilled off under a reduced pressure and the residue was refined by silica gel chromatography, whereby the Compound C-39 of the present invention (6.46 g) (yield 76%) was obtained.

The other couplers of the present invention can by synthesized in a similar manner.

The amount of the cyan coupler of the present invention in a light-sensitive material is suitably $1\times10^{-3}$ to 1 mole, preferably $2\times10^{-3}$ to $3\times10^{-1}$ mole per mole of silver halide in the silver halide emulsion layer containing the cyan coupler.

Next, the yellow coupler represented by formula (III) will be explained in detail.

In formula (III), $R_4$ is preferably an aryl group having 6 to 24 carbon atoms (for example, phenyl, p-tolyl, o-tolyl, 4-methoxyphenyl, 2-methoxyphenyl, 4-butoxyphenyl, 4-octyloxyphenyl, 4-hexadecyloxyphenyl, and 1-naphthyl) or a tertiary alkyl group having 4 to 24 carbon atoms (for example, t-butyl, t-pentyl, t-hexyl, 1,1,3,3-tetramethylbutyl, 1-adamantyl, 1,1-dimethyl-2-chloroethyl, 2-phenoxy-2-propyl, and bicyclo[2,2,2]-octane-1-yl). $R_4$ is particularly preferably a 2 or 4-alkoxyaryl group (for example, 4-methoxyphenyl, 4-butoxyphenyl, and 2-methoxyphenyl) or t-butyl, most preferably t-butyl.

In formula (III), $R_5$ represents preferably a fluorine atom, an alkyl group having 1 to 24 carbon atoms (for example, methyl, ethyl, isopropyl, t-butyl, cyclopentyl, n-octyl, n-hexadecyl, and benzyl), an aryl group having 6 to 24 carbon atoms (for example, phenyl, p-tolyl, o-tolyl, and 4-methoxyphenyl), an alkoxy group having 1 to 24 carbon atoms (for example, methoxy, ethoxy, butoxy, n-octyloxy, n-tetradecyloxy, benzyloxy, and methoxyethoxy), an aryloxy group having 6 to 24 carbon atoms (for example, phenoxy, p-tolyloxy, o-tolyloxy, p-methoxyphenoxy, p-dimethylaminophenoxy, and m-pentadecylphenoxy). a dialkylamino group having 2 to 24 carbon atoms (including an amino group in which these alkyl groups are combined with each other to form a ring, for example, dimethylamino, diethylamino, pyrolidino, piperidino, and morpholino), an alkylthio group having 1 to 24 carbon atoms (for example, methylthio, butylthio, n-octylthio, and n-hexadecylthio), or an arylthio group having 6 to 24 carbon atoms (for example, phenylthio, 4-methoxyphenyl-thio, 4-t-butylphenylthio, and 4-dodecylphenylthio). $R_5$ is more preferably an alkoxy group, an aryloxy group, or a dialkylamino group, further preferably an alkoxy group or a dialkylamino group, particularly preferably methoxy or dimethylamino, and most preferably dimethylamino.

In formula (III), L represents —O—*, —COO—*, —NHCO—*, —NHCOCHR$_7$—*, —NHCO(CH$_2$)$_m$—*, —CONH—*, —CONH(CH$_2$)$_m$—*, —CONHCHR$_7$—*, —SO$_2$NR$_7$(CH$_2$)$_m$—*, —NHSO$_2$—*, or —NHSO$_2$(CH$_2$)$_m$—*; $R_7$ represents a hydrogen atom or an alkyl group; * represents the bonding direction to $R_6$; m represents an integer of 1 to 4. L is preferably —O—*, —COO—*, —NHCO—*, —NHCOCHR$_7$—*, —NHCO(CH$_2$)$_m$—*, —CONH(CH$_2$)$_m$—*, —SO$_2$NH(CH$_2$)$_m$—*, or —NHSO$_2$—*, more preferably —O—*, —NHCO—*, —NHCOCHR$_7$—*, or —NHCO(CH$_2$)$_m$—*.

In formula (III), $R_6$ represents a halogen atom, an unsubstituted alkyl group, an unsubstituted aryl group, an unsubstituted alkoxy group, an unsubstituted aryloxy group, an alkyl-substituted aryl group, an alkoxy-substituted aryl group, an alkyl-substituted aryloxy group, or an aralkyloxy group, wherein the alkyl portion and alkoxy portion thereof may be linear or branched. The alkyl group or alkoxy group substituted to an aryl group or aryloxy group in an alkyl-substituted aryl group, an alkoxy-substituted aryl group, and an alkyl-substituted aryloxy group may be single or plural; and when it is plural, the alkyl groups or alkoxy groups each may be the same or different.

In formula (III), $R_6$ represents preferably a halogen atom (a fluorine atom, a chlorine atom, a bromine atom and an iodine atom), an unsubstituted alkyl group having 1 to 24 carbon atoms (for example, methyl, t-butyl, n-octyl, n-dodecyl, n-tridecyl, and n-hexadecyl), an unsubstituted aryl group having 6 to 24 carbon atoms (for example, phenyl and naphthyl), an unsubstituted alkoxy group having 1 to 24 carbon atoms (for example, methoxy, n-butoxy, n-octyloxy, n-tetradecyloxy, and n-hexadecyloxy), an unsubstituted aryloxy group having 6 to 24 carbon atoms (for example, phenoxy), an alkyl-substituted aryl group having 7 to 25 carbon atoms (for example, p-methylphenyl), an alkoxy-substituted aryl group having 7 to 25 carbon atoms (for example, p-methoxyphenyl and p-dodecoxyphenyl), an alkyl-substituted aryloxy group having 7 to 25 carbon atoms (for example, 2,4-di-t-butylphenoxy and 2,4-di-t-amylphenoxy), or an aralkyloxy group having 8 to 36 carbon atoms (for example, phenylethyloxy).

$R_6$ is more preferably an unsubstituted alkyl group having 8 to 24 carbon atoms, an unsubstituted alkoxy group having 8 to 24 carbon atoms, an alkoxy-substituted aryl group having 10 to 25 carbon atoms, or an alkyl-substituted aryloxy group having 10 to 25 carbon atoms, particularly preferably an unsubstituted alkyl group having 8 to 24 carbon atoms or an alkyl-substituted aryloxy group having 10 to 25 carbon atoms.

In formula (III), L-$R_6$ is preferably provided at least at a para position or meta position to the acylacetamido group (a meta position or a para position, respectively, to $R_5$), more preferably at the para position to the acylacetamido group (the meta position to $R_5$).

In formula (III), r represents an integer of 0 to 4, preferably an integer of 1 or 2. When r is plural, the plural L-$R_6$ groups may be the same or different. Particularly preferably r is 1.

In formula (III), $X_1$ represents preferably a group capable of splitting off upon a coupling reaction with an oxidation product of an aromatic primary amine color developing agent (hereinafter referred to as a splitting-off group). There can be given as examples of the splitting-off group $X_1$, a halogen atom (for example, fluorine, chlorine, bromine and iodine), a heterocyclic group having 1 to 24 carbon atoms, bonded to a coupling active site via a nitrogen atom, an aryloxy group having 6 to 24 carbon atoms, an arylthio group having 6 to 24 carbon atoms (for example, phenylthio, p-t-butylphenylthio, p-chlorophenylthio, and p-carboxyphenylthio), an acyloxy group having 1 to 24 carbon atoms (for example, acetoxy, benzoyloxy, and dodecanoyloxy), an alkyl-sulfonyloxy group having 1 to 24 carbon atoms (for example, methylsulfonyloxy, butylsulfonyloxy, and dodecylsulfonyloxy), an arylsulfonyloxy group having 6 to 24 carbon atoms (for example, benzenesulfonyloxy and p-chlorophenylsulfonyloxy), or a heterocyclic oxy group having 1 to 24 carbon atoms (for example, 3-pyridyloxy and 1-phenyl-1,2,3,3-tetrazole-5-yloxy), more preferably a heterocyclic group bonded to a coupling active site via a nitrogen atom, or an aryloxy group.

When $X_1$ represents a heterocyclic group bonded to a coupling active site via a nitrogen atom, $X_1$ is preferably a monocyclic or condensed 5 to 7-membered heterocyclic ring which may contain a hetero atom selected from oxygen, sulfur, phosphorous, selenium and tellurium in addition to a nitrogen atom and may be substituted. There are available as examples thereof, succinimide, maleimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazoline-2-one, thiazoline-2-one, benzimidazoline-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, and 2-pyrazone. These heterocyclic rings may be substituted. There can be given as examples of the substituents for the heterocyclic rings, the groups enumerated for the above $R_6$ as well as a hydroxy group, a carboxyl group, a sulfo group, an amino group (for example, amino, N-methylamino, N,N-dimethylamino, anilino, pyrolidino, piperidino, and morpholino).

When $X_1$ represents the above heterocyclic group, $X_1$ is represented preferably by the following formula (IV):

(IV)

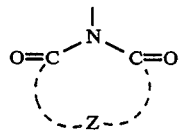

wherein Z is

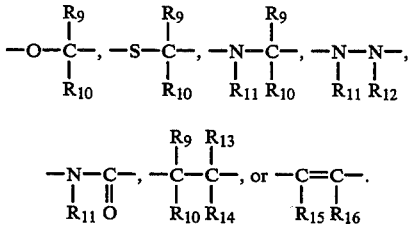

wherein $R_9$, $R_{10}$, $R_{13}$ and $R_{14}$ each represents a hydrogen atom, an alkyl group, an aryl group, an alkoxy group, an aryloxy group, an alkylthio group, an arylthio group, an alkylsulfonyl group, an arylsulfonyl group, and an amino group; $R_{11}$ and $R_{12}$ each represent a hydrogen atom, an alkyl group, an aryl group, an alkylsulfonyl group, an arylsulfonyl group, and an alkoxycarbonyl group; $R_{15}$ and $R_{16}$ each represent a hydrogen atom and an aryl group; $R_{15}$ and $R_{16}$ may be combined with each other to form a benzene ring; and $R_9$ and $R_{10}$, $R_{10}$ and $R_{11}$, $R_{11}$ and $R_{12}$ or $R_9$ and $R_{13}$ may be combined with each other to form a ring (for example, cyclobutane, cyclohexane, cycloheptane, cyclohexene, pyrrolidine, and piperidine).

Of the heterocyclic rings represented by formula (IV), particularly preferred is the heterocyclic group in which Z in formula (IV) is:

(IV)

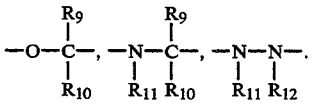

The total number of carbon atoms of the heterocyclic group represented by formula (IV) is 2 to 24, preferably 4 to 20 and more preferably 5 to 16. There are available as examples of the heterocyclic group represented by formula (IV), succinimide, maleimide, phthalimide, 1-methylimidazolidine-2,4-dione-3-yl, 1-benzylimidazolidine-2,4-dione-3-yl, 5,5-dimethyloxazolidine-2,4-dione-3-yl, 5-methyl-5-propyloxazolidine-2,4-dione-3-yl, 5,5-dimethyl-thiazolidine-2,4-dione-3-yl, 5,5-dimethylimidazolidine-2,4-dione-3-yl, 3-methylimidazolidinetrione-1-yl, 1,2,4-triazolidine-3,5-dione-4-yl, 1-methyl-2-phenyl-1,2,4-triazolidine-3,5-dione-4-yl, 1-benzyl-2-phenyl-1,2,4-triazolidine-3,5-dione-4-yl, 5-hexyloxy-1-methylimidazolidine-2,4-dione-3-yl, 1-benzyl-5-ethoxyimidazilidine-2,4-dione-3-yl, and 1-benzyl-5-dodecyloxyimidazolidine-2,4-dione-3-yl.

Of the above heterocyclic groups, imidazolidine-2,4-dione-3-yl (for example, 1-benzyl-imidazolidine-2,4-dione-3-yl) is most preferred.

When $X_1$ represents an aryloxy group, $X_1$ has preferably 6 to 24 carbon atoms and the aryl group may be substituted. Preferred as the substituents therefor are a carboxyl group, a sulfo group, a cyano group, a nitro group, an alkoxycarbonyl group, a halogen atom, a carbonamido group, a sulfonamido group, a carbamoyl group, a sulfamoyl group, an alkyl group, an alkylsulfonyl group, an arylsulfonyl group, and an acyl group. In particular, the most preferred examples are 4-carboxyphenoxy, 4-methylsulfonyl-phenoxy, 4-(4-benzyloxphenylsulfonyl)phenoxy, 4-(4-hydroxyphenylsulfonyl)-phenoxy, 2-chloro-4-(3-chloro-4-hydroxyphenylsulfonyl)phenoxy, 4-methoxycarbonylphenoxy, 2-chloro-4-methoxycarbonylphenoxy, 2-acetamide-4-methoxycarbonylphenoxy, 4-isopropoxycarbonylphenoxy, 4-cyanophenoxy, 2-[N-(2-hydroxyethyl)carbamoyl]-phenoxy, 4-nitrophenoxy, 2,5-dichlorophenoxy, 2,3,5-trichlorophenoxy, 4-methoxycarbonyl-2-methoxyphenoxy, and 4-(3-carboxypropanamide)phenoxy.

The coupler represented by formula (III) may form a dimer or a higher polymer than a dimer by combining with each other via a divalent or higher valent group resulting from the removal of one hydrogen atom from $R_4$, $X_1$ or

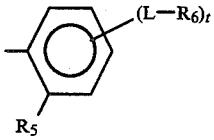

wherein the above substituents may have carbon atoms different from the ranges described above.

Where the coupler represented by formula (III) forms a polymer, a typical example thereof is a homopolymer or copolymer of an addition polymer ethylene type unsaturated compound (a yellow color developing monomer) having a yellow dye-forming coupler group. In this case, the polymer contains a repetitive unit represented by the following formula (V) and one or more kinds of the yellow color development repetitive unit represented by formula (V) may be contained in the polymer, or it may be a copolymer containing one or more kinds of a non-color developable ethylene type monomer as a copolymerization component:

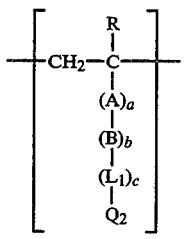

(V)

wherein R represents a hydrogen atom, an alkyl group having 1 to 4 carbon atoms, or a chlorine atom; A represents —CONH—, —COO—, or a substituted or unsubstituted phenylene group; B represents a substituted or unsubstituted alkylene group, phenylene group or aralkylene group; $L_1$ represents —CONH—, —NHCONH—, —NHCOO—, —NHCO—, —OCONH—, —NH—, —COO—, —OCO—, —CO—, —O—, —S—, —$SO_2$—, —$NHSO_2$—, or —$SO_2NH$—; a, b and c each represent 0 and 1; and $Q_2$ represents a yellow coupler group formed by making a hydrogen atom split off from the group represented by $R_4$, $X_1$ or

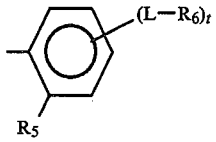

in the yellow coupler represented by formula (III).

Preferred as the polymer is a copolymer of the yellow color developing monomer represented by the coupler unit of formula (V) and the following non-color developable ethylene type monomer.

There are available as the non-color developable ethylene type monomer which is not capable of coupling with an oxidation product of an aromatic primary amine developing agent, acrylic acid, α-chloroacrylic acid, α-alkylacrylic acid (for example, methacrylic acid), an amide or ester derived from these acrylic acids (for example, acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), a vinyl ester (for example, vinyl acetate, vinyl propionate, and vinyl laurate), acrylonitrile, methacrylonitrile, an aromatic vinyl compound (for example, styrene and derivatives thereof, for example, vinyltoluene, divinylbenzene, vinylacetophenone, and sulfostyrene), itaconic acid, citraconic acid, crotonic acid, vinylidene chloride, a vinylalkyl ether (for example, vinylethyl ether), maleic acid ester, N-vinyl-2-pyrrolidone, N-vinylpyridine, 2-vinylpyridine and 4-vinylpyridine.

Particularly preferred are acrylic acid ester, methacrylic acid ester, and maleic acid ester. The noncolor developable ethylene type monomer used herewith can be used in combination of two or more kinds of monomers. For example, there can be used methyl methacrylate and butyl acrylate, butyl acrylate and styrene, butyl methacrylate and methacrylic acid, and methyl acrylate and diacetone acrylamide.

As known in the art of a polymer coupler, the ethylene type unsaturated monomer for copolymerizing with the vinyl type monomer corresponding to the compound represented by formula (V) can be selected so that the physical properties and/or chemical properties of the copolymer formed, for example, solubility, compatibility with a binder for a photographic colloid composition, such as gelatin, and flexibility and thermal stability thereof, are favorably affected.

The yellow polymer couplers used in the present invention may be prepared by emulsifying and dispersing a hydrophobic polymer coupler obtained by the polymerization of a vinyl type monomer giving the coupler unit represented by the above formula (V) in a gelatin aqueous solution in a latex form after dissolving it in an organic solvent, or by a direct emulsion polymerization.

There can be used the method described in U.S. Pat. No. 3,451,820 for emulsifying and dispersing a hydrophobic polymer coupler in a gelatin aqueous solution in a latex form, and the method described in U.S. Pat. Nos. 4,080,211 and 3,370,952 for an emulsion polymerization.

Specific examples of L—$R_6$ and $X_1$ in the yellow coupler represented by formula (III) are shown below, but the present invention is not limited thereto.

Specific examples of $X_1$ are as follows:

(1)

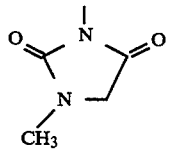

(2)

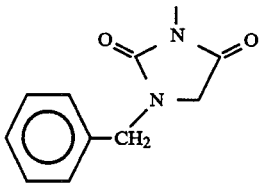

(3)

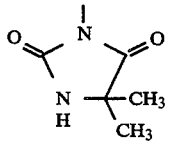

(4)

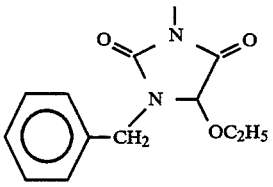

(5)

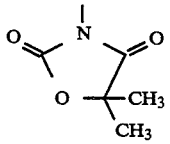

(6)

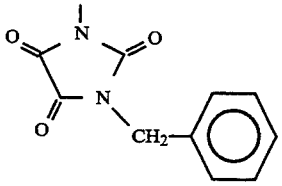

(7)

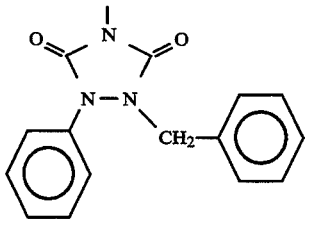

-continued (8)

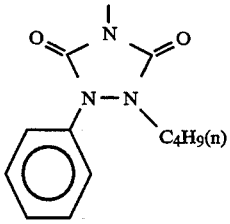

(9)

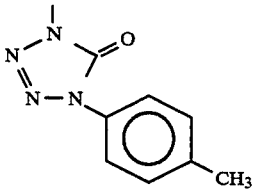

(10)

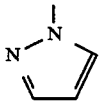

(11)

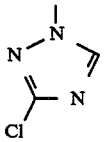

(12)

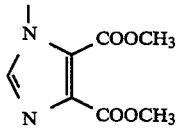

(13)

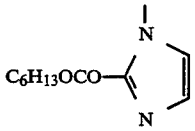

(14)

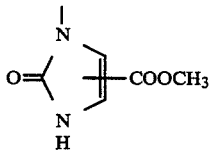

(15)

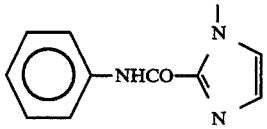

(16)

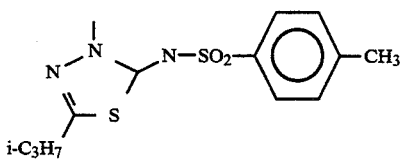

-continued (17)

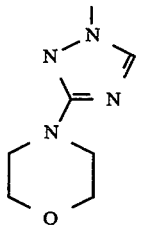

(18)

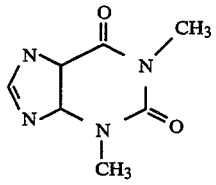

(19)

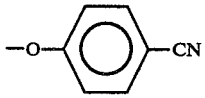

(20)

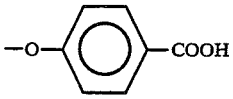

(21)

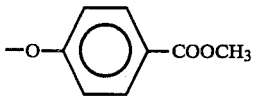

(22)

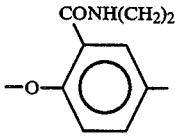

(23)

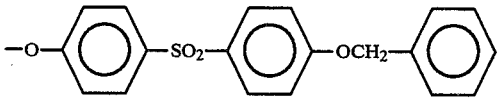

(24)

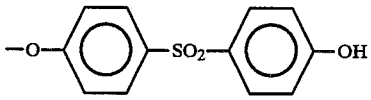

(25)

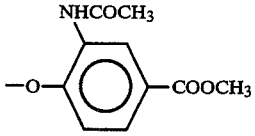

Next, the concrete examples of L—$R_6$ are shown below:

$-NHCOC_{13}H_{27}$-n (30)

(31)

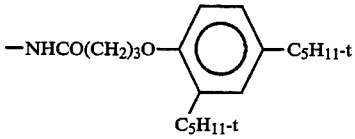

(32)

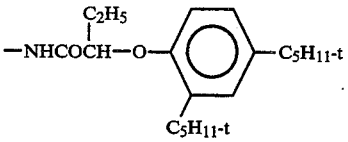

$-OC_{16}H_{33}$-n (33)

$-NHCOCHC_8H_{17}$-n (34)
$C_6H_{13}$ (35)

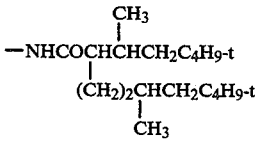

$-NHSO_2C_{12}H_{25}$-n (36)

$-NHSO_2C_{16}H_{33}$-n (37)

(38)

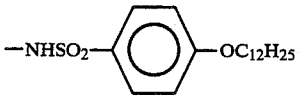

$-COOC_{14}H_{29}$ (39)

$-CONHC_{14}H_{29}$ (40)

$-OC_8H_{17}$-n (41)

(42)

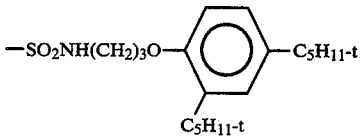

$-CONH(CH_2)_3OC_{12}H_{25}$ (43)

$-NHCOC_{14}H_{29}$-n (44)

Next, the concrete examples of the yellow dye forming coupler represented by Formula (III) used in the present invention are shown in the following tables:

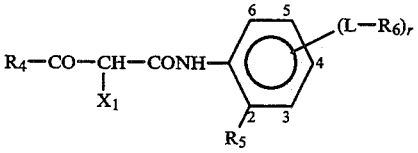

| No. | $R_4$ | $R_5$ | $(L—R_6)_r$ | $X_1$ |
|---|---|---|---|---|
| Y-1 | t-$C_4H_9$— | —$OCH_3$ | (32) [5] | (4) |
| Y-2 | t-$C_4H_9$— | —$CH_3$ | (32) [5] | (4) |
| Y-3 | t-$C_4H_9$— | —$C_2H_5$ | (31) [5] | (2) |

-continued
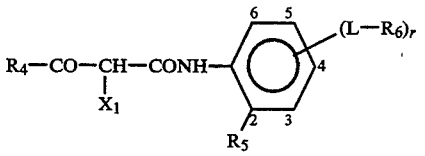
| No. | $R_4$ | $R_5$ | $(L—R_6)_r$ | $X_1$ |
|---|---|---|---|---|
| Y-4 | t-$C_4H_9$— | 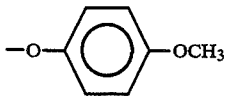 | (32) [5] | (5) |
| Y-5 | t-$C_4H_9$— | 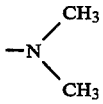 | (32) [5] | (4) |
| Y-6 | t-$C_4H_9$— | —$OCH_3$ | (31) [5] | (23) |
| Y-7 | t-$C_4H_9$— | 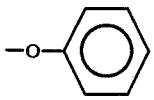 | (37) [5] | (19) |
| Y-8 | t-$C_4H_9$— | —$OC_8H_{17}$-n | (41) [4] | (5) |
| Y-9 | t-$C_4H_9$— | —$OC_8H_{17}$-n | (41) [5] | (5) |
| Y-10 | t-$C_4H_9$— | —$CH_3$ | (32) [4] | (4) |
| Y-11 | t-$C_4H_9$— | 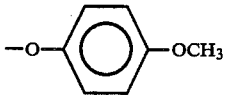 | (30) [5] | (10) |
| Y-12 | t-$C_4H_9$— | —$OC_{16}H_{33}$-n | — | (15) |
| Y-13 | t-$C_4H_9$— | —$C_2H_5$ | (43) [5] | (8) |
| Y-14 | t-$C_4H_9$— | —$OCH_3$ | (42) [5] | (2) |
| Y-15 | t-$C_4H_9$— | —$OC_8H_{17}$-n | (41) [4]<br>(41) [5] | (5) |
| Y-16 | t-$C_4H_9$— | —$OCH_3$ | (31) [5] | (19) |
| Y-17 | t-$C_4H_9$— | 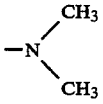 | (34) [4] | (18) |
| Y-18 | t-$C_4H_9$— | 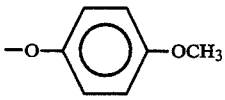 | (38) [5] | (11) |
| Y-19 | t-$C_4H_9$— | 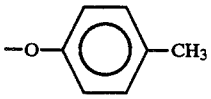 | (35) [5] | (3) |
| Y-20 | t-$C_4H_9$— | —$OC_2H_5$ | (35) [5] | (1) |
| Y-21 | t-$C_4H_9$— | —$OCH_3$ | (32) [5] | (5) |
| Y-22 | 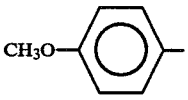 | —$OCH_3$ | (46) [5] | (4) |
| Y-23 | 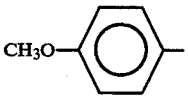 | 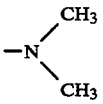 | (37) [5] | (4) |
| Y-24 | t-$C_4H_9$— | —$OCH_3$ | (39) [5] | (5) |

In the above tables, the numerals in the parentheses represent the numbers referred to the specific examples of $X_1$ and $R_6$ and the numbers in [ ] represent the substitution positions on an anilide group.

In the dye formed by the reaction of the yellow coupler of the present invention with N-ethyl-N-(β-methanesulfonamidethyl)-3-methyl-4-aminoaniline, the wavelength at a longer wavelength side than an absorption peak wavelength, which provides a reflection density of 0.4 in a spectral reflection spectrum of a portion in which the density of the yellow dye at the absorption peak wavelength is 1.0, resides preferably at a shorter wavelength side than 508 nm, more preferably at a shorter wavelength side than 505 nm, and particularly preferably at a shorter wavelength side than 505 nm and a longer wavelength side than 490 nm.

The yellow coupler of the present invention may be used singly or in the mixture of two or more kinds as long as the effects of the present invention can be demonstrated, or may be used in combination with conventionally known yellow dye-forming couplers.

The couplers of the present invention can be synthesized by the conventional synthesis methods and specific examples thereof are the methods described in JP-A-63-123047 and European Patent EP 041668A2.

The amount of the yellow coupler of the present invention which is present in the light-sensitive material is generally $1\times10^{-5}$ mole to $10^{-2}$ mole per $m^2$, preferably $1\times10^{-4}$ mole to $5\times10^{-3}$ mole per $m^2$, and more preferably $2\times10^{-4}$ mole to $10^{-3}$ mole per $m^2$ of light-sensitive material.

In the light-sensitive material of the present invention, a pyrazoloazole type magnenta coupler is preferably used in a silver halide emulsion layer containing a magenta dye-forming coupler.

The pyrazoloazole magenta coupler which can be preferably used in the present invention is represented by the following formula (M):

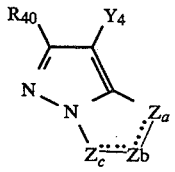

(M)

wherein $R_{40}$ represents a hydrogen atom or a substituent; $Z_a$, $Z_b$ and $Z_c$ each represents methine, substituted methine, =N—, or —NH—; one of the $Z_a$–$Z_b$ bond and the $Z_b$–$Z_c$ bond is a double bond and the other is a single bond; where the $Z_b$–$Z_c$ bond is a carbon-carbon double bond, it may be a part of an aromatic ring; $Y_4$ represents a hydrogen atom or a group capable of splitting off upon a reaction with an oxidation product of an aromatic primary amine color developing agent; and where $R_{40}$, or $Y_4$ are substituents or $Z_a$, $Z_b$ and $Z_c$ are substituted methines, a polymer higher than a dimer may be formed with the substituents thereof.

Among the pyrazoloazole type couplers represented by formula (M), preferred in terms of the absorption characteristic of the dye image which is formed are imidazo[1,2-b]pyrazoles described in U.S. Pat. No. 4,500,630, pyrazolo[1,5-b][1,2,4]triazoles described in U.S. Pat. No. 4,540,654, and pyrazolo[5,1-c][1,2,4]triazoles described in U.S. Pat. No. 3,725,067. Of them, pyrazolo[1,5-b][1,2,4]triazoles are particularly preferred in terms of light fastness.

The details of the substituents for the azole ring represented by $R_{40}$, $Y_4$ and $Z_a$, $Z_b$ and $Z_c$ are described, for example, on the 41st line of the second column to the 27th line of the eighth column of U.S. Pat. No. 4,540,654. Preferred are a pyrazoloazole coupler in which a branched alkyl group is bonded to a 2, 3 or 6-position of a pyrazolotriazole ring, described in JP-A-61-65245, a pyrazoloazole coupler containing a sulfonamido group in a molecule, described in JP-A-61-65246, a pyrazoloazole coupler having an alkoxyphenylsulfonamido ballast group, described in JP-A-61-147254, a pyrazolotriazole coupler having an alkoxy group or an aryloxy group at a 6-position, described in JP-A-62-209457 or JP-A-63-307453, and a pyrazolotriazole coupler having a carbonamido group in a molecule, described in JP-A-1-22279.

Specific examples of the pyrazolotriazole couplers represented by formula (M) are enumerated below, but not limited thereto:

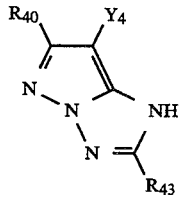

| Compound | $R_{40}$ | $R_{43}$ | $Y_4$ |
|---|---|---|---|
| M-1 | $CH_3$— | 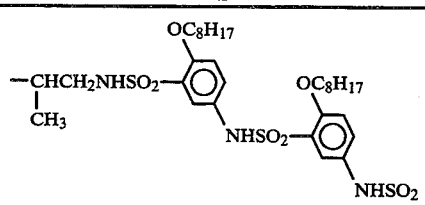 | Cl |

-continued
| | | | |
|---|---|---|---|
| M-2 | $CH_3$— | 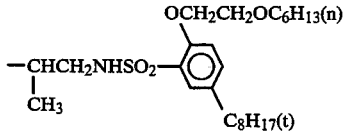 | Cl |
| M-3 | $(CH_3)_3C$— | 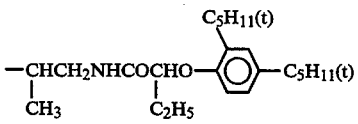 | 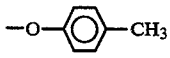 |
| M-4 | 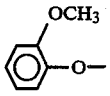 | 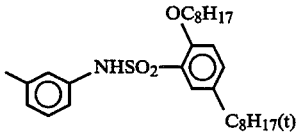 | 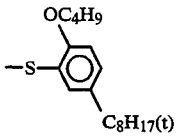 |
| M-5 | $CH_3$— | 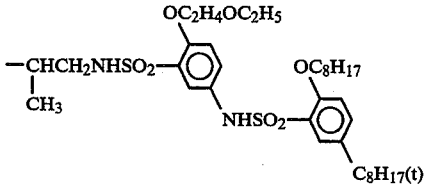 | Cl |
| M-6 | $CH_3$— | 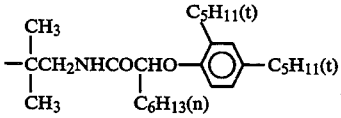 | Cl |
| M-7 | $CH_3$— | 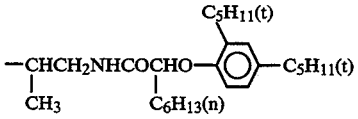 | Cl |
| M-8 | —$CH_3$ | 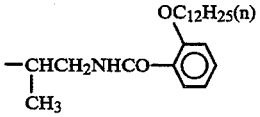 | Cl |
| M-9 | $CH_3$— | 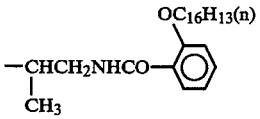 | Cl |
| M-10 | 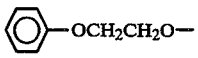 | 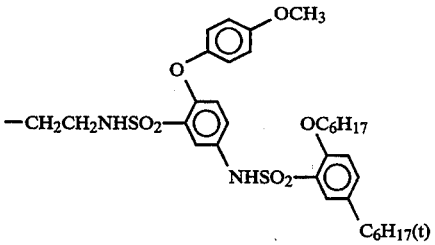 | 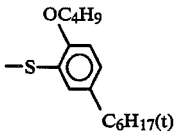 |
| M-11 | $CH_3CH_2O$— | " | " |
| M-12 | 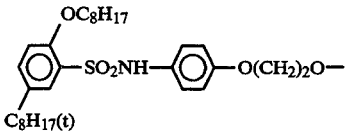 | 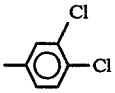 | 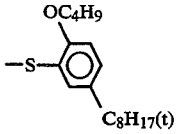 |

-continued
| | | | |
|---|---|---|---|
| M-13 | 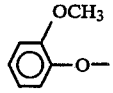 | 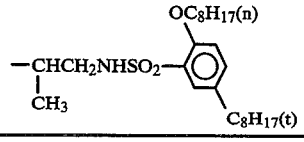 | Cl |
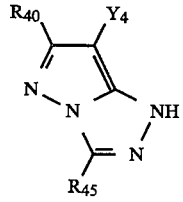
| Compound | $R_{40}$ | $R_{45}$ | $Y_4$ |
|---|---|---|---|
| M-14 | $CH_3$— | 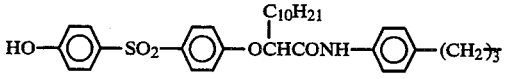 | Cl |
| M-15 | $CH_3$— | 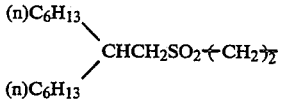 | Cl |
| M-16 | 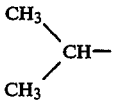 | 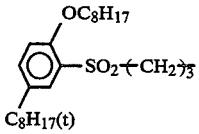 | Cl |
| M-17 | 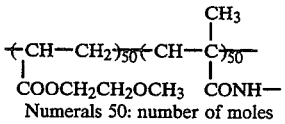 Numerals 50: number of moles | 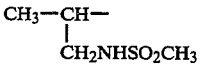 | Cl |
| M-18 | 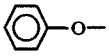 | 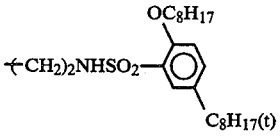 | Cl |
| M-19 | $CH_3$— | 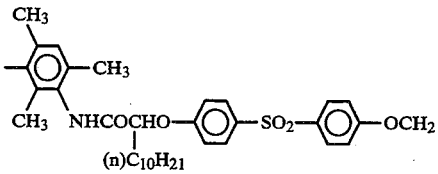 | Cl |
| M-20 | $(CH_3)_3C$— | 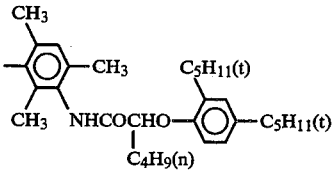 | Cl |
| M-21 | 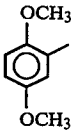 | 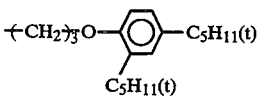 | Cl |
| M-22 | $CH_3$— | 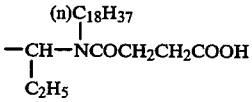 | Cl |
Specific examples and synthesis examples other than the above examples are described in U.S. Pat. Nos. 4,540,654 and 4,705,863, JP-A-61-65245, JP-A-62-

209457 and JP-A-62-249155, JP-B-47-27411 (the term "JP-B" as used herewith means an examined published Japanese patent application), and U.S. Pat. No. 3,725,067.

In the present invention, the amount of the magenta coupler used in a light-sensitive material is $1\times10^{-5}$ to $10^{-2}$ mole, preferably $5\times10^{-5}$ to $5\times10^{-3}$ mole per $m^2$ of the light-sensitive material.

The respective couplers of the present invention can be introduced into a light-sensitive material by various conventional dispersing methods. Preferred is an oil-in-water dispersion method in which they are dissolved in a high boiling solvent (a low boiling solvent is used in combination according to necessity) and are emulsified and dispersed in an aqueous gelatin solution which can be added to a silver halide emulsion.

Examples of the high boiling solvent used in the oil-in-water dispersion method are described in U.S. Pat. No. 2,322,027.

A high boiling organic solvent for a photographic additive such as a coupler, which can be used in the present invention, can be used if it is a compound which is immiscible with water, has a melting point of 100° C. or lower and a boiling point of 140° C. or higher, and is a good solvent for a coupler. The melting point of the high boiling organic solvent is preferably 80° C. or lower. The boiling point of the high boiling organic solvent is preferably 160° C. or higher, more preferably 170° C. or higher.

The details of these high boiling organic solvents are described in a right lower column at page 137 to a right upper column at page 144 of JP-A-62-215272.

The couplers of the present invention can also be incorporated into the light-sensitive material by latex dispersing methods. Examples of polymer dispersing methods and examples of a latex for impregnation are described in U.S. Pat. No. 4,199,363, German Patent Applications (OLS) 2,541,274 and 2,541,230, JP-B-53-41091, and European Patent Publication 029104. Further, a dispersion method by an organic solvent-soluble polymer is described in PCT International Patent Publication WO88/00723.

The light-sensitive material of the present invention has as respective silver halide emulsion layers, at least one silver halide emulsion layer containing a yellow dye-forming coupler of the present invention, at least one silver halide emulsion layer containing a magenta dye-forming coupler, and at least one silver halide emulsion layer containing a cyan dye-forming coupler of the present invention, and the respective layers are preferably blue-sensitive, green-sensitive and red-sensitive. Also, the light-sensitive material of the present invention can be of the constitution in which the layers are provided on a support in this order, but the order may be different from this. Further, an infrared-sensitive silver halide emulsion layer may be replaced for at least one of the above light-sensitive layers.

There can be used as silver halide used in the present invention, silver chloride, silver bromide, silver bromochloroiodide, and silver bromoiodide. Particularly in terms of effectively demonstrating the effects of the present invention and for the purpose of rapid processing, preferably used is a silver chlorobromide emulsion containing substantially no silver iodide and having a silver chloride content of 90 mole % or more, more preferably 95 mole % or more, and particularly 98 mole % or more, or a silver chloride emulsion.

For the purpose of improving sharpness of an image, there are preferably incorporated into a hydrophilic colloid layer of the light-sensitive material according to the present invention so that the optical reflection density of the light-sensitive material at 680 nm becomes 0.70 or more, dyes (among them, an oxonol type dye) capable of being decolored by processing, described at pages 27 to 76 of European Patent EP 0,337,490A2, and into a hydrophobic resin layer of a support, titanium oxide which is subjected to a surface treatment with di- to tetrahydric alcohols (for example, trimethylolethane) in a proportion of 12% by weight or more (more preferably 14% by weight or more).

Also, in the light-sensitive material according to the present invention, the color image preservability-improving compounds described in European Patent EP 0,277,589A2 are preferably used together with a coupler. In particular, they are preferably used in combination with a pyrazoloazole coupler.

Preferably used simultaneously or singly for preventing side effects of, for example, the generation of stain due to the reaction of a color developing agent or an oxidation product thereof remaining in a layer during storage after processing with a coupler are the compounds (A) described in European Patent EP 0,277,589A2, which chemically combine with an aromatic amine type developing agent remaining after color development processing to form a chemically inactive and substantially colorless compound, and/or the compounds (B) described in European Patent EP 0,277,589A2, which chemically combine with the oxidation product of an aromatic amine type developing agent remaining after color development processing to form a chemically inactive and substantially colorless compound.

Further, anti-mold agents such as described in JP-A-63-271247 are preferably added to the light-sensitive material according to the present invention for the purpose of preventing various molds and bacteria which grow in a hydrophilic colloid layer to deteriorate an image.

There may be used as a support for the light-sensitive material according to the present invention for display, a white color polyester type support or a support in which a layer containing a white pigment is provided on a support side having a silver halide emulsion layer. An anti-halation layer is preferably provided on a support side coated thereon with a silver halide emulsion layer or the backside thereof in order to further improve sharpness. In particular, the transmission density of a support is controlled preferably to be 0.35 to 0.8 so that a display can be viewed with either a reflected light or a transmitted light.

The light-sensitive material according to the present invention may be exposed with either a visible ray or an infrared ray. The method of exposure may be either a low illuminance exposure or a high illuminance and short time exposure. Particularly in the latter case, preferred is a laser scanning exposing method in which the exposing time per picture element is shorter than $10^{-4}$ second.

During exposure, a band stop filter described in U.S. Pat. No. 4,880,726 is preferably used, whereby a light mixture is removed to notably improve color reproduction.

Preferred silver halide emulsions, other materials (additives), photographic constitutional layers (layer arrangements), the processing methods, and additives for processing for use with the photographic material of the present invention include those described in the following patent publications, particularly European Patent EP 0,355,660A2 (JP-A-2-139544).

| Photographic element | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, lines 20 to 22. |
| Silver halide solvent | p. 12, left lower column, line 6 to 14, and p. 13, left upper column, line 3 from bottom to p. 18, left lower column, last line. | — | — |
| Chemical sensitizer | p. 12, left lower column, line 3 from bottom to right lower column, line 5 from bottom, and p. 18, right lower column, line 1 to p. 22, right upper column, line 9 from bottom. | p. 29, right lower column, line 12 to last line. | p. 47, lines 4 to 9. |
| Spectral sensitizer (spectral sensitizing method) | p. 22, right upper column, line 8 from bottom to p. 38, last line. | p. 30, left upper column, lines 1 to 13. | p. 47, lines 10 to 15. |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers | p. 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column, line 11. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, lines 33 to 40, and p. 65, line 2 to 21. |
| High boiling and/or low boiling organic solvent | p. 137, left lower column, line 9 to p. 144, right upper column, last line. | p. 35, right lower column, line 14 to p. 36, left upper, line 4. | p. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | p. 63, line 51 to p. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, line 3 to 9. | — | — |
| Support | p. 155, right lower column, line 19 to p. 156, left upper column, line 14. | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, lines 1 to 15. | p. 45, lines 41 to 52. |
| Dye | p. 156, right lower column, line 15 to p. 184, right | p. 38, left upper column, line 12 to right upper | p. 66, lines 18 to 22. |

-continued

| Photographic element | JP-A-62-215272 | JP-A-2-33144 | EP 0355660A2 |
|---|---|---|---|
| | lower column, last line. | column, line 7. | |
| Anti-color mixing agent | p. 185, left upper column, line 1 to p. 188, right lower column, line 3. | p. 36, right upper column, line 8 to 11. | p. 64, line 57 to line 1. |
| Gradation controller | p. 188, right lower column, line 4 to 8. | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and anti-adhesion agent) | p. 210, left lower column, line 1 to p. 222, left lower column, line 5. | p. 25, left upper column, line 1 to p. 27, right lower column, line 9. | |
| Binder (hydrophilic colloid) | p. 222, left lower column, line 6 to p. 225, left upper column, last line | p. 38, right upper column, lines 8 to 18. | p. 66, lines 23 to 28. |
| Thickener | p. 225, right upper column, line 1 to p. 227, right upper column, line 2. | — | — |
| Anti-electrification agent | p. 227, right upper column, line 3 to p. 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the subject matter amended according to the Amendment of March 16, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

The method described in the left upper column at page 27 to the right upper column at page 34 of JP-A-2-207250 can be preferably applied as a method for processing a silver halide color light-sensitive material in which a high silver chloride emulsion having a silver chloride content of 90 mole % or more is used.

EXAMPLES

The present invention will be explained below with reference to the examples, but is not limited thereto.

EXAMPLE 1

A paper support laminated on both sides thereof with polyethylene, which was subjected to a corona discharge treatment, was provided with a gelatin subbing layer containing sodium dodecylbenzenesulfonate, and further was coated with the various photographic constitutional layers, whereby a multilayered color photographic paper (Sample A) having the following layer constitution was prepared. The coating solutions were prepared in the following manner.

Preparation of the fifth layer coating solution

Ethyl acetate (50.0 ml) and a solvent (Solv-6) (14.0 g) were added to a cyan coupler (ExC) (32.0 g), a dye image stabilizer (Cpd-2) (3.0 g), a dye image stabilizer (Cpd-4) (2.0 g), a dye image stabilizer (Cpd-6) (18.0 g), a dye image stabilizer (Cpd-7) (40.0 g), and a dye image stabilizer (Cpd-8) (5.0 g) to dissolve them. This solution was added to a 20% aqueous gelatin solution (500 ml) containing sodium dodecylbenzenesulfonate (8 g), and then was dispersed in an emulsion with a supersonic homogenizer to thereby prepare an emulsified dispersion.

Meanwhile, there was prepared a silver bromochloride emulsion (cube, a 1:4 mixture by Ag mole ratio of a large size emulsion with an average grain size of 0.58 μm and a small size emulsion with an average grain size of 0.45 μm, wherein the variation coefficients were 0.09 and 0.11, respectively, and both size emulsions contained grains in which AgBr 0.6 mol % was localized on a part of the surface thereof). Added to this emulsion was the following red-sensitive sensitizing dye E in an amount of $0.9\times10^{-4}$ mole per mole of silver based on the large size emulsion and $1.1\times10^{-4}$ mole per mole of silver based on the small size emulsion. Further, this emulsion was subjected to a chemical ripening after adding a sulfur sensitizer and a gold sensitizer. The foregoing emulsified dispersion and this red-sensitive silver bromochloride emulsion were mixed and dissolved, whereby the fifth layer coating solution was prepared so that it was of the following composition.

The coating solutions for the 1st layer to 4th layer, the 6th layer and the 7th layer were prepared in a similar manner as the 5th layer coating solution. H-1 and H-2 were used as a gelatin hardener for the respective layers. Further, Cpd-10 and Cpd-11 were added to the respective layers so that the entire amounts thereof became 25.0 mg/m$^2$ and 50.0 mg/m$^2$, respectively.

The following spectral sensitizing dyes were used for the silver bromochloride emulsions contained in the respective light-sensitive emulsion layers.

Blue-sensitive emulsion layer

Sensitizing dye A

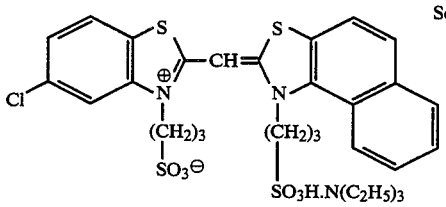

and

Sensitizing dye B

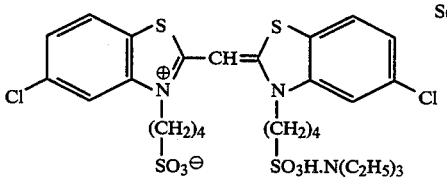

(each $2.0\times10^{-4}$ mole per mole of silver halide to the large size emulsion and each $2.5\times10^{-4}$ mole per mole of silver halide to the small size emulsion).

Green-sensitive emulsion layer

Sensitizing dye C

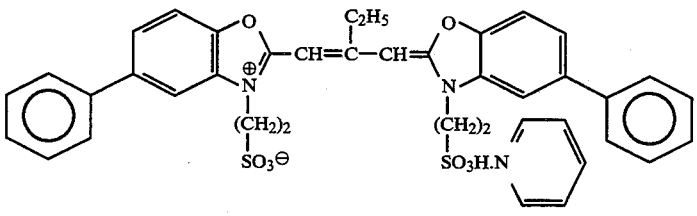

($4.0\times10^{-4}$ mole per mole of silver halide to the large size emulsion and $5.6\times10^{-4}$ mole per mole of silver halide to the small size emulsion), and Sensitizing dye D

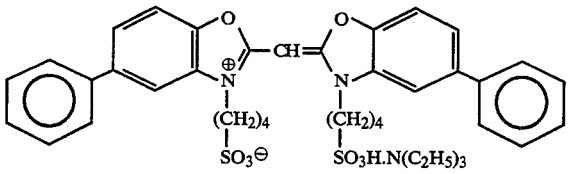

($7.0\times10^{-5}$ mole per mole of silver halide to the large size emulsion and $1.0\times10^{-5}$ mole per mole of silver halide to the small size emulsion).

Red-sensitive emulsion layer

Sensitizing dye E

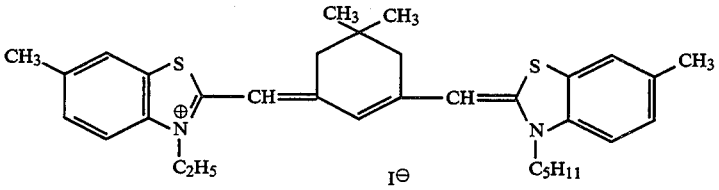

($0.9\times10^{-4}$ mole per mole of silver halide to the large size emulsion and $1.1\times10^{-4}$ mole per mole of silver halide to the small size emulsion).

Further, the following compound was added in an amount of $2.6\times10^{-3}$ mole per mole of silver:

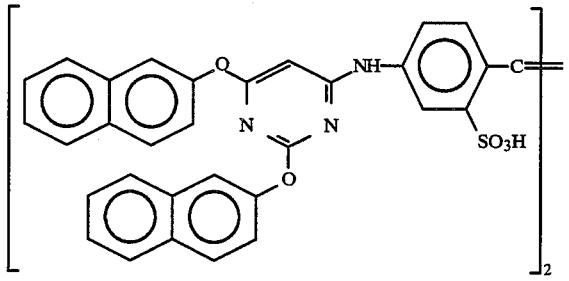

Further, there was added to the blue-sensitive layer, green-sensitive layer and red-sensitive layer, (5-methylureidophenyl)-5-mercaptotetrazole in the amounts of $8.5\times10^{-5}$ mole, $7.7\times10^{-4}$ mole and $2.5\times10^{-4}$ mole per mole of silver halide, respectively.

Further, there was added to the blue-sensitive layer and green-sensitive layer, 4-hydroxy-6-methyl-1,3,3a,7-tetrazaindene in the amounts of $1\times10^{-4}$ mole and $2\times10^{-4}$ mole per mole of silver halide, respectively.

The following dyes (the number in the parenthesis represents a coated amount) were added to the following emulsion layers for preventing irradiation:

First layer (blue-sensitive emulsion layer)

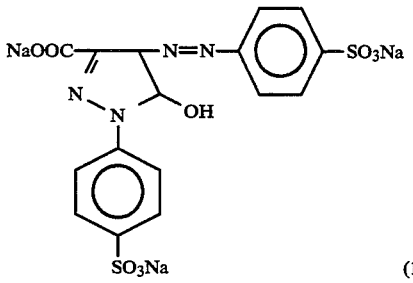

(10 mg/m²)

Third layer (green-sensitive emulsion layer)

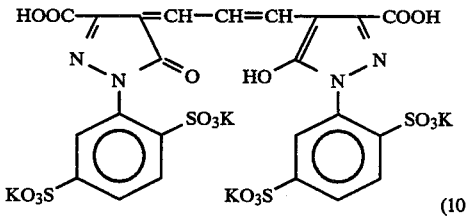

(10 mg/m²)

Fifth layer (red-sensitive emulsion layer )

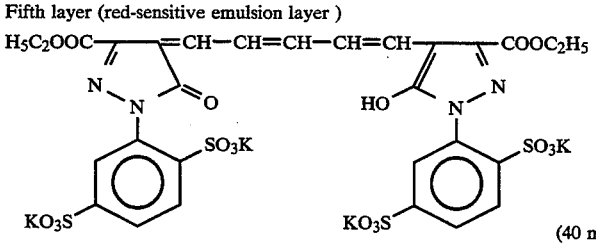

(40 mg/m²)

and

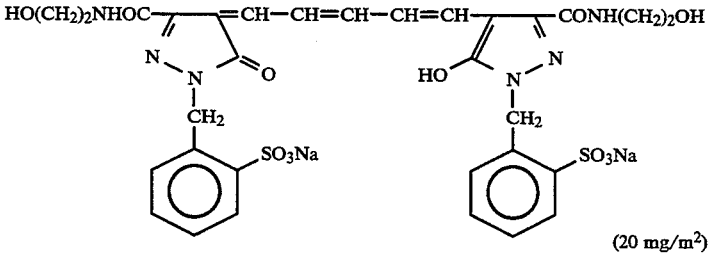

(20 mg/m²)

Layer constitution

The compositions of the respective layers are shown below. The numbers represent the coated amounts (g/m²). The coated amounts of the silver halide emulsions are expressed in terms of the amounts converted to silver.

Support:

Polyethylene laminated paper (polyethylene coated on the 1st layer side contains a white pigment/$TiO_2$ and a blue dye/ultramarine).

| | Coated Amounts |
|---|---|
| First layer: a blue-sensitive emulsion layer | |
| Silver bromochloride emulsion (cube; 3:7 mixture (silver mole ratio) of a large size emulsion having an average grain size of 0.88 μm and a small size emulsion having an average grain size of 0.70 μm, wherein the variation coefficients in the grain size distributions are 0.08 and 0.10, respectively, | 0.26 |

-continued

| | Coated Amounts |
|---|---|
| and both size emulsions contain the grains in which AgBr 0.3 mol % is, localized on a part of the surface thereof) | |
| Gelatin | 1.52 |
| Yellow coupler (ExY) | 0.48 |
| Dye image stabilizer (Cpd-1) | 0.19 |
| Solvent (Solv-3) | 0.18 |
| Dye image stabilizer (Cpd-7) | 0.06 |
| Dye image stabilizer (Cpd-9) | 0.04 |
| Stabilizer (Cpd-12) | 0.01 |
| Second layer: an anti-color mixing layer | |
| Gelatin | 0.99 |
| Anti-color mixing agent (Cpd-5) | 0.08 |
| Solvent (Solv-1) | 0.16 |
| Solvent (Solv-4) | 0.08 |
| Third layer: a green-sensitive emulsion layer | |
| Silver bromochloride emulsion (cube; 1:3 mixture (silver mole ratio) of a large size emulsion having an average grain size of 0.55 μm and a small size emulsion having an average grain size of 0.39 μm, wherein the variation coefficients of the grain size distribu- | 0.12 |

-continued

| | Coated Amounts |
|---|---|
| tions are 0.10 and 0.08, respectively, and both size emulsions contain the grains in which AgBr 0.8 mol % is localized on a part of the surface thereof) | |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| Fourth layer: a UV absorbing layer | |
| Gelatin | 1.58 |
| UV absorber (UV-1) | 0.47 |
| Anti-color mixing agent (Cpd-5) | 0.05 |
| Solvent (Solv-5) | 0.24 |
| Fifth layer: a red-sensitive emulsion layer | |
| Silver bromochloride emulsion (cube; 1:4 mixture (silver mole ratio) of a large size emulsion having an average grain size of 0.58 μm and a small size emulsion having an average grain size of 0.45 μm, wherein the variation coefficients of the grain size distributions are 0.09 | 0.23 |

-continued

| | Coated Amounts |
|---|---|
| and 0.11, respectively, and both size emulsions contain the grains in which AgBr 0.6 mol % is localized on a part of the surface thereof) | |
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-8) | 0.05 |
| Solvent (Solv-6) | 0.14 |
| Sixth layer: a UV absorbing layer | |
| Gelatin | 0.53 |
| UV absorber (UV-1) | 0.16 |
| Anti-color mixing agent (Cpd-5) | 0.02 |
| Solvent (Solv-5) | 0.08 |
| Seventh layer: a protective layer | |
| Gelatin | 1.33 |
| Acryl-modified copolymer of polyvinyl alcohol (a modification degree: 17%) | 0.17 |
| Liquid paraffin | 0.03 |

The compounds used in this example are set forth below:

Yellow coupler (ExY)

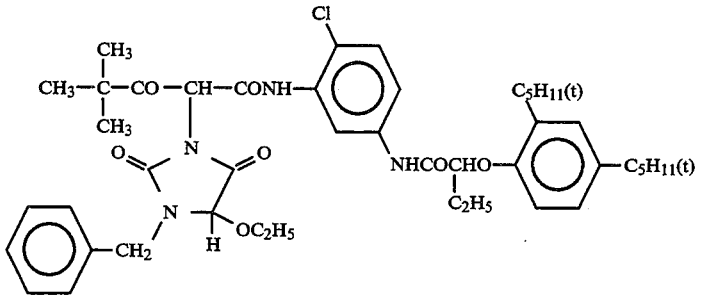

Magenta coupler (ExM)

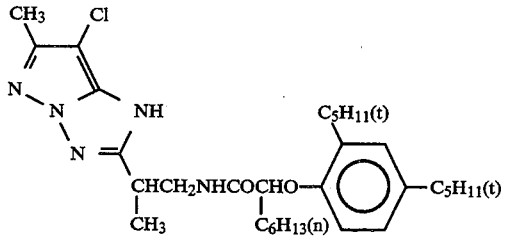

Cyan coupler (ExC)

A 2:3:5 mixture (mole ratio) of:

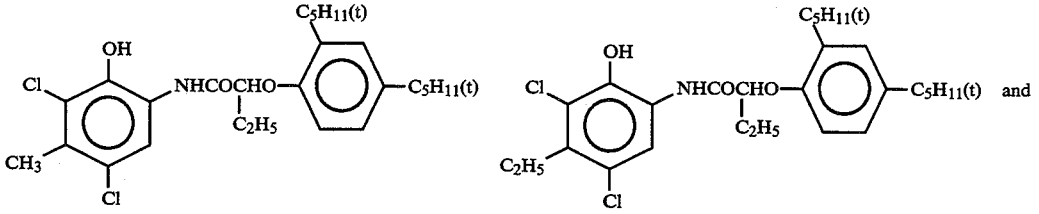

-continued
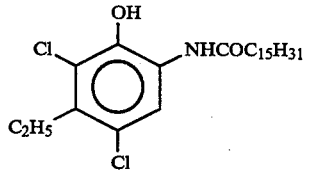
Dye image stabilizer (Cpd-1)
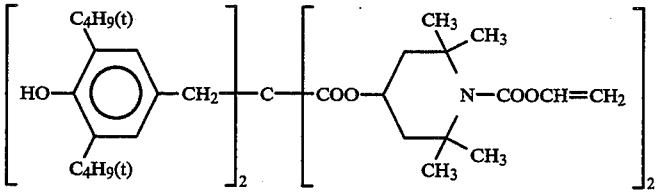
Dye image stabilizer (Cpd-2)
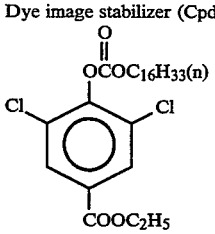
Dye image stabilizer (Cpd-3)
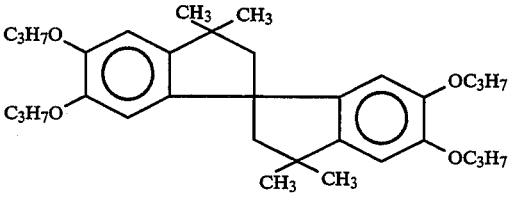
Dye image stabilizer (Cpd-4)
A 1:1 mixture (mole ratio) of:
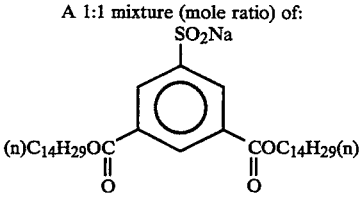
and
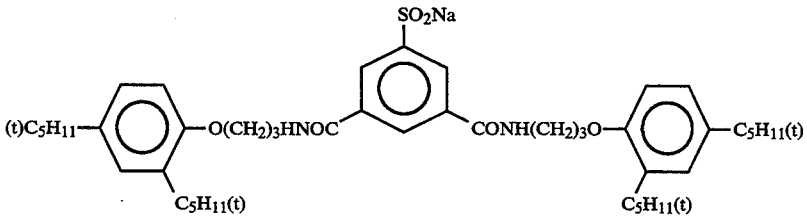
Dye image stabilizer (Cpd-5)
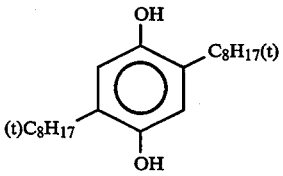
Dye image stabilizer (Cpd-6)

-continued
A 2:4:4 mixture (weight ratio) of:
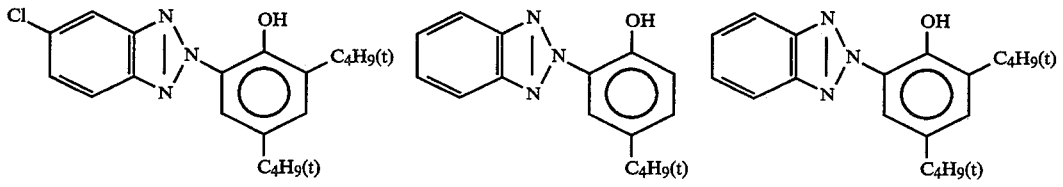
Dye image stabilizer (Cpd-8)
A 1:1 mixture (mole ratio) of:
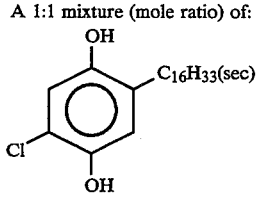
and
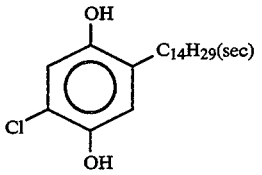
Dye image stabilizer (Cpd-9)
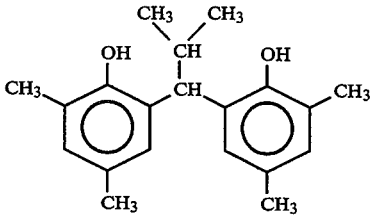
Preservative (Cpd-10)
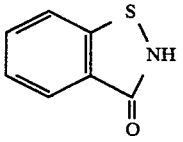
Preservative (Cpd-11)
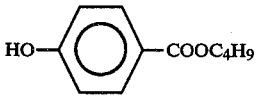
Stabilizer (Cpd-12)
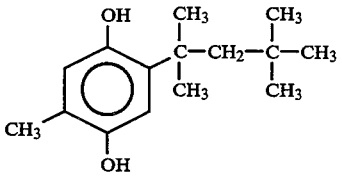
UV absorber (UV-1)
A 4:2:4 mixture (weight ratio) of:

-continued
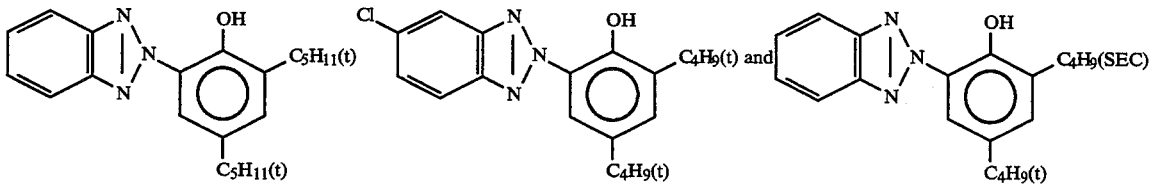
(H-1)
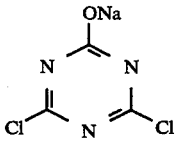
(H-2)
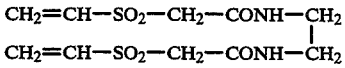
Solvent (Solv-1)
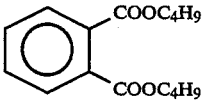
Solvent (Solv-2)
A 1:1 mixture (mole ratio) of:
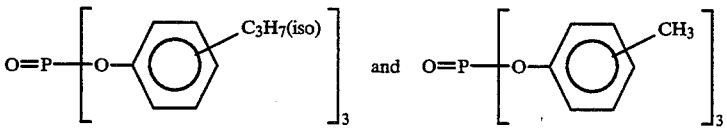
Solvent (Solv-3)
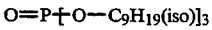
Solvent (Solv-4)
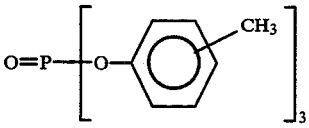
Solvent (Solv-5)
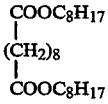
Solvent (Solv-6)
A 80:20 mixture (volume ratio) of:
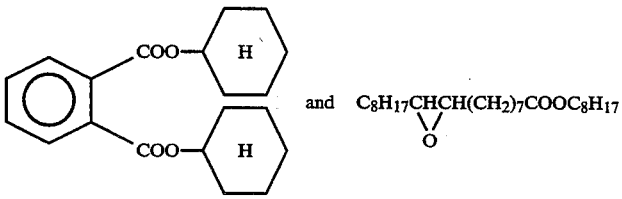
Solvent (Solv-7)

-continued

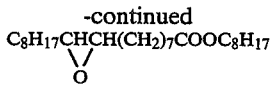

Next, Samples B to T were prepared in the same manner as Sample A, except that the yellow coupler (ExY) contained in the first layer/blue-sensitive layer and the cyan coupler (ExC) contained in the fifth layer/red-sensitive layer were replaced with an equimolar amount of the yellow coupler and cyan coupler as shown in Table A below, respectively.

The respective samples thus obtained were subjected to a gradational exposure via a three colors separation filter with a sensitometer (FWH type, manufactured by Fuji Photo Film Co., Ltd., a color temperature of a light source: 3200° K.), wherein the exposure was given so that an exposure became 250 CMS at an exposing time of 0.1 second.

The exposed samples were processed by the following steps with a paper processing machine in the processing solutions of the following compositions.

| Processing step | Temperature | Time |
|---|---|---|
| Color developing | 35° C. | 45 seconds |
| Bleach/fixing | 30 to 34° C. | 45 seconds |
| Rinsing 1 | 30 to 34° C. | 20 seconds |
| Rinsing 2 | 30 to 34° C. | 20 seconds |
| Rinsing 3 | 30 to 34° C. | 20 seconds |
| Drying | 70 to 80° C. | 60 seconds |

The compositions of the respective processing solutions are as follows:

| | Tank solution |
|---|---|
| Color developing solution | |
| Water | 800 ml |
| Ethylenediamine-N,N,N,N-tetramethylene phosphonic acid | 1.5 g |
| Potassium bromide | 0.015 g |
| Triethanolamine | 8.0 g |
| Sodium chloride | 1.4 g |
| Potassium carbonate | 25. g |
| N-ethyl-N-(β-methanesulfonamidethyl)-3-methyl-4-aminoaniline sulfate | 5.0 g |
| N,N-bis(carboxymethyl)hydrazine | 4.0 g |
| Sodium N,N-di(sulfoethyl)hydroxylamine | 4.0 g |
| Fluorescent whitening agent (Whitex 4B manufactured by Sumitomo Chem. Ind.) | 1.0 g |
| Water was added to | 1000 ml |
| pH (25° C.) | 10.05 |
| Bleach/fixing solution | |
| Water | 400 ml |
| Ammonium thiosulfate (700 g/liter) | 100 ml |
| Sodium sulfite | 17 g |
| Iron (III) ammonium ethylenediamine-tetracetate | 55 g |
| Disodium ethylenediaminetetracetate | 5 g |
| Ammonium bromide | 40 g |
| Water was added to | 1000 ml |
| pH (25° C.) | 6.0 |
| Rinsing solution | |
| Deionized water (amounts of calcium ions and magnesium ions: each 3 ppm or lower) | |

The respective samples processed as above were subjected to a measurement of reflection density with a TCD type densitometer manufactured by Fuji Photo Film Co., Ltd. to obtain the minimum density (Dmin).

The respective samples were subjected to an exposure via a color negative film photographing the cloths of various colors, and then to a processing in the same manner as above, and then were subjected to an evaluation of color reproducibility. In the visual evaluation, superiority or inferiority of the color reproducibility (hue and chroma) as compared with that of Sample A for comparison was judged. The results are shown in Table A.

TABLE A

| Sample No. | Yellow coupler | Cyan coupler | Color reproducibility* Yellow | Cyan | Red | Green | Blue | Yellow Dmin |
|---|---|---|---|---|---|---|---|---|
| A (Comp.) | ExY | ExC | Δ | Δ | Δ | Δ | Δ | 0.05 |
| B (Comp.) | ExY | C-16 | Δ | ○ | Δ | Δ | ○ | 0.05 |
| C (Comp.) | ExY-2 | ExC | ○ | Δ | ○ | Δ | Δ | 0.07 |
| D (Comp.) | ExY-2 | C-16 | ○ | ○ | ○ | ○ | ○ | 0.07 |
| E (Comp.) | Y-1 | ExC | ○ | Δ | ○ | Δ | Δ | 0.05 |
| F (Inv.) | Y-1 | C-1 | ○ | ○ | ○ | ○ | ○ | 0.05 |
| G (Inv.) | Y-1 | C-16 | ○ | ○ | ○ | ○ | ○ | 0.04 |
| H (Inv.) | Y-1 | C-19 | ○ | ○ | ○ | ○ | ○ | 0.04 |
| I (Inv.) | Y-1 | C-3 | ○ | ○ | ○ | ○ | ○ | 0.04 |
| J (Inv.) | Y-4 | C-31 | ○ | ○ | ○ | ○ | ○ | 0.04 |
| K (Inv.) | Y-4 | C-4 | ○ | ○ | ○ | ○ | ○ | 0.05 |
| L (Inv.) | Y-8 | C-16 | ○ | ○ | ○ | ○ | ○ | 0.04 |
| M (Inv.) | Y-8 | C-19 | ○ | ○ | ○ | ○ | ○ | 0.04 |
| N (Inv.) | Y-15 | C-16 | ○ | ○ | ○ | ○ | ○ | 0.05 |
| O (Inv.) | Y-15 | C-19 | ○ | ○ | ○ | ○ | ○ | 0.05 |
| P (Inv.) | Y-21 | C-16 | ○ | ○ | ○ | ○ | ○ | 0.04 |
| Q (Inv.) | Y-21 | C-3 | ○ | ○ | ○ | ○ | ○ | 0.04 |
| R (Inv.) | Y-21 | C-31 | ○ | ○ | ○ | ○ | ○ | 0.04 |
| S (Inv.) | Y-21 | C-20 | ○ | ○ | ○ | ○ | ○ | 0.04 |
| T (Inv.) | Y-21 | C-39 | ○ | ○ | ○ | ○ | ○ | 0.04 |

*Color reproducibility:
Δ means that the corresponding Samples are equivalent to Sample No. A.
○ means that the corresponding Samples are superior to Sample No. A.

The yellow coupler (ExY-2) used for comparison is the following compound:

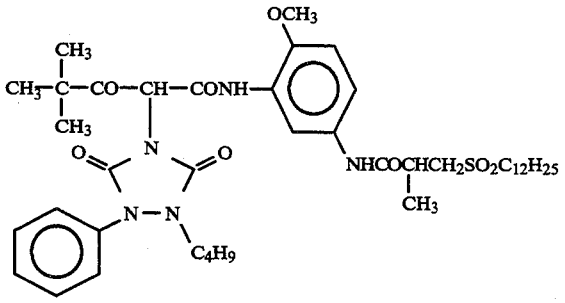

As can be found from the results shown in Table A, the light-sensitive materials of the present invention has an excellent color reproducibility in all hues and a sufficiently low minimum density.

EXAMPLE 2

There were coated the following first layer to fourteenth layer on a surface side of a paper support (thickness: 100 μm) laminated on both sides thereof with polyethylene and the fifteenth layer to sixteenth on the back side thereof, whereby a color photographic light-sensitive material was prepared. Polyethylene coated on the first layer side contained titanium oxide (4 g/m$^2$) as a white pigment and a trace amount (0.003 g/m$^2$) of ultramarine as a blueing dye stuff (the chromaticities on the surface of the support were 88.0, −0.20 and −0.75 in the L*, a* and b* system).

Light-sensitive layer composition

The components and coated amounts (g/m$^2$) are shown below, wherein the coated amount of silver halide is shown in terms of an amount converted to silver. The emulsions used for the respective layers were prepared according to the method for preparing the emulsion EM-1 which is described below, except that a Lipman emulsion which was not subjected to a surface chemical sensitization was used as the emulsion for the fourteenth layer.

| | Coated Amounts |
|---|---|
| First layer (an anti-halation layer): | |
| Black colloidal silver | 0.10 |
| Anti-color mixing agent (Cpd-7) | 0.05 |
| Gelatin | 0.70 |
| Second layer (an intermediate layer): | |
| Gelatin | 0.70 |
| Third layer (a low red-sensitive layer): | |
| Silver bromide spectrally sensitized by the red color sensitizing dyes (ExS-1, 2 and 3) (an average grain size: 0.25 μm, grain size distribution (variation coefficient): 8%, octahedron) | 0.04 |
| Silver chlorobromide spectrally sensitized by the red color sensitizing dyes (ExS-1,2 and 3) (silver chloride: 5 mole %, average grain size: 0.40 μm gain size distribution: 10%, octahedron) | 0.08 |
| Gelatin | 1.00 |
| Cyan couplers (ExC-1, 2 and 3 in a weight ratio of 1:1:0.2) | 0.30 |
| Anti-fading agent (Cpd-1, 2, 3, 4 and 30 in equal amounts) | 0.18 |
| Anti-stain agent (Cpd-5) | 0.003 |
| Coupler dispersant (Cpd-6) | 0.03 |
| Coupler solvent (Solv-1, 2 and 3 in equal amounts by weight) | 0.12 |
| Fourth layer (a high red-sensitive layer): | |
| Silver bromide spectrally sensitized by the red color sensitizing dyes (ExS-1, 2 and 3) (average grain size: 0.60 μm, grain size distribution: 15%, octahedron) | 0.14 |
| Gelatin | 1.00 |
| Cyan couplers (ExC-1, 2 and 3 in a weight ratio of 1:1:0.2) | 0.30 |
| Anti-fading agent (Cpd-1, 2, 3, 4 and 30 in equal amounts by weight) | 0.18 |
| Coupler dispersant (Cpd-6) | 0.03 |
| Coupler solvent (Solv 1, 2 and 3 in equal amounts by weight) | 0.12 |
| Fifth layer (an intermediate layer): | |
| Gelatin | 1.00 |
| Anti-color mixing agent (Cpd-7) | 0.08 |
| Anti-color mixing agent solvent (Solv-4 and 5 in equal amounts by weight) | 0.05 |
| Polymer latex (Cpd-8) | 0.10 |
| Sixth layer (a low green sensitive layer): | |
| Silver bromide spectrally sensitized by the green color sensitizing dye (ExS-4) (average grain size: 0.25 μm, grain size distribution: 8% octahedron) | 0.04 |
| Silver chlorobromide spectrally sensitized by the green color sensitizing dye (ExS-4) (silver chloride: 5 mole %, average grain size: 0.40 μm, grain size distribution: 10% octahedron) | 0.06 |
| Gelatin | 0.80 |
| Magenta couplers (ExM-1, 2 and 3 in equal amounts by weight) | 0.11 |
| Anti-fading agent (Cpd-9, 26 and 30 in equal amounts by weight) | 0.15 |
| Anti-stain agent (Cpd-10, 11, 12 and 13 in a weight ratio of 10:7:7:1) | 0.025 |
| Coupler dispersant (Cpd-6) | 0.05 |
| Coupler solvent (Solv-4 and 6 in equal amounts by weight) | 0.15 |
| Seventh layer (a high green-sensitive layer): | |
| Silver bromide spectrally sensitized by the green color sensitizing dyes (ExS-4) (an average grain size: 0.65 μm, a grain size distribution: 16%, octahedron) | 0.10 |
| Gelatin | 0.80 |
| Magenta couplers (ExM-1, 2 and 3 in equal amounts by weight) | 0.11 |
| Anti-fading agent (Cpd-9, 26 and 30 in equal amounts by weight) | 0.15 |
| Anti-stain agent (Cpd-10, 11, 12 and 13 in a weight ratio of 10:7:7:1) | 0.025 |
| Coupler dispersant (Cpd-6) | 0.05 |
| Coupler solvent (Solv-4 and 6 in equal amounts by weight) | 0.15 |
| Eighth layer (an intermediate layer): | |
| The same as the fifth layer | |
| Ninth layer (a Yellow filter layer): | |
| Yellow colloidal silver (a grain size: 100 A) | 0.12 |
| Gelatin | 0.70 |
| Anti-color mixing agent (Cpd-7) | 0.03 |
| Anti-color mixing agent solvent (Solv-4 and 5 in equal amounts by weight) | 0.10 |
| Polymer latex (Cpd-8) | 0.07 |
| Tenth layer (an intermediate layer): | |
| The same as the fifth layer | |
| Eleventh layer (a low blue-sensitive layer): | |
| Silver bromide spectrally sensitized by the blue color sensitizing dyes (ExS-5 and 6) (average grain size: 0.40 μm, grain size distribution: 8%, octahedron) | 0.07 |
| Silver chlorobromide spectrally sensitized by the blue color sensitizing dyes (ExS-5 and 6) (silver chloride: 8 mole %, average grain size: 0.60 μm, grain size distribution: 11%, octahedron) | 0.14 |
| Gelatin | 0.80 |
| Yellow couplers (ExY-1 and 2 in equal amounts by weight) | 0.35 |

-continued

| | Coated Amounts |
|---|---|
| Anti-fading agent (Cpd-14) | 0.10 |
| Anti-fading agent (Cpd-30) | 0.05 |
| Anti-stain agent (Cpd-5 and 15 in a weight ratio of 1:5) | 0.007 |
| Coupler dispersant (Cpd-6) | 0.05 |
| Coupler solvent (Solv-2) | 0.10 |
| Twelfth layer (a high blue-sensitive layer): | |
| Silver bromide spectrally sensitized by the blue color sensitizing dyes (ExS-5 and 6) (average grain size: 0.85 μm, grain size distribution: 18%, octahedron) | 0.15 |
| Gelatin | 0.60 |
| Yellow couplers (ExY-1 and 2 in equal amounts by weight) | 0.30 |
| Anti-fading agent (Cpd-14) | 0.10 |
| Anti-fading agent (Cpd-30) | 0.05 |
| Anti-stain agent (Cpd-5 and 15 in a weight ratio of 1:5) | 0.007 |
| Coupler dispersant (Cpd-6) | 0.05 |
| Coupler solvent (Solv-2) | 0.10 |
| Thirteenth layer (a UV absorbing layer): | |
| Gelatin | 1.00 |
| UV absorber (Cpd-2, 4 and 16 in equal amounts by weight) | 0.50 |
| Anti-color mixing agent (Cpd-7 and 17 in equal amounts by weight) | 0.03 |
| Dispersant (Cpd-6) | 0.02 |
| UV absorber solvent (Solv-2 and 7 in equal amounts by weight) | 0.08 |
| Anti-irradiation dye (Cpd-18, 19, 20, 21 and 27 in a weight ratio of 10:10:13:15:20) | 0.05 |
| Fourteenth layer (a protective layer): | |
| Silver bromochloride fine grains (silver chloride: 97 mole %, average grain size: 0.1 μm) | 0.03 |
| Acryl-modified copolymer of polyvinyl-alcohol (molecular weight: 50,000) | 0.01 |
| Polymethyl methacrylate particles (average particle size: 2.4 μm) and silicone oxide (an average particle size: 5 μm) in equal amounts | 0.05 |
| Gelatin | 1.80 |
| Gelatin hardener (H-1 and H-2 in equal amounts by weight) | 0.18 |
| Fifteenth layer (a back layer): | |
| Gelatin | 2.50 |
| UV absorber (Cpd-2, 4 and 16 in equal amounts by weight) | 0.50 |
| Dye (Cpd-18, 19, 20, 21 and 27 in equal amounts) | 0.06 |
| Sixteenth layer ( a protective back layer): | |
| Polymethyl methacrylate particles (average particle size: 2.4 μm) and silicone oxide (average particle size: 5 μm) in equal amounts | 0.05 |
| Gelatin | 2.00 |
| Gelatin hardener (H-1 and H-2 in equal amounts by weight) | 0.14 |

Preparation of emulsion EM-1

Solutions of potassium bromide and silver nitrate were simultaneously added to a gelatin aqueous solution over a period of 15 minutes at 75° C. while vigorously stirring to thereby obtain octahedral silver bromide grains having an average grain size of 0.35 m, wherein 3,4-dimethyl-1,3-thiazoline-2-thione of 0.3 g per mole of silver was added. Sodium thiosulfate in an amount of 6 mg and chlorauric acid (tetrahydrate) in an amount of 7 mg, each amount being per mole of silver, were subsequently added to this emulsion and heated at 75° C. for 80 minutes to thereby carry out a chemical sensitization processing. The grains thus obtained as a core were further grown in the same environmental condition as the first time, whereby an octahedral monodispersed core/shell silver bromide emulsion having an average grain size of 0.7 μ was finally obtained. The variation coefficient of the grains was about 10%. Sodium thiosulfate in an amount of 1.5 mg and chlorauric acid (tetrahydrate) in an amount of 1.5 mg, each amount being per mole of silver, were added to this emulsion and heated at 60° C. for 60 minutes to carry out a chemical sensitization processing, whereby an inner latent image type silver halide emulsion was obtained.

There were used for the respective layers ExZK-1 and ExZK-2 as a nucleus forming agent in the amounts of 0.001% and 0.01% by weight, respectively, based on the amount of silver halide, and Cpd-22, 28 and 29 as a nucleus forming accelerator each in an amount of 0.01% by weight based on the amount of silver halide. Further, there were used for the respective layers Alkanol XC (Du Pont Co., Ltd.) and sodium alkylbenzenesulfonate as an emulsion dispersion aid and citric acid ester and Magefac F-120 (Dainippon Ink Chemical Co., Ltd.) as a coating aid. Cpd-23, 24 and 25 were used in silver halide and colloidal silver-containing layers as a stabilizer. This sample was designated as Sample No. 201.

The compounds used in the example are shown below:

ExS-1

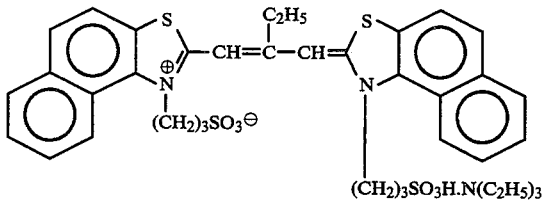

-continued
ExS-2
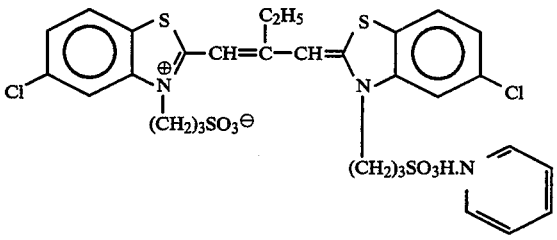
ExS-3
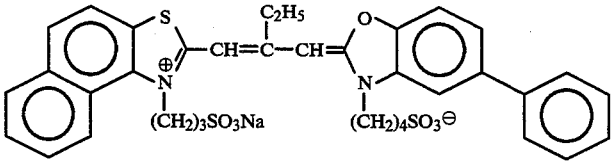
ExS-4
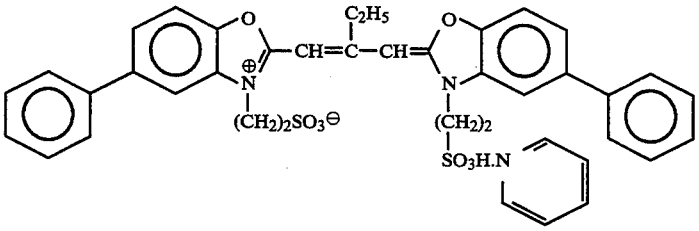
ExS-5
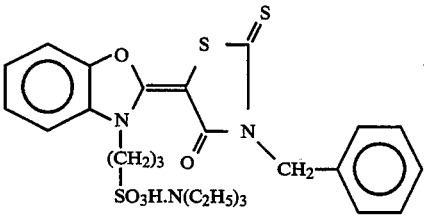
ExS-6
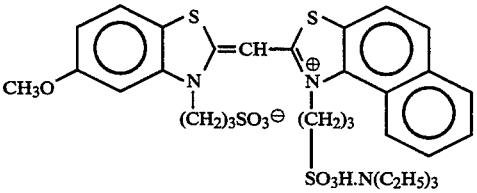
Cpd-1
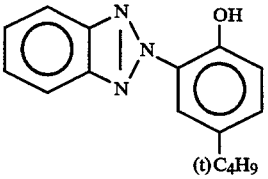
Cpd-2
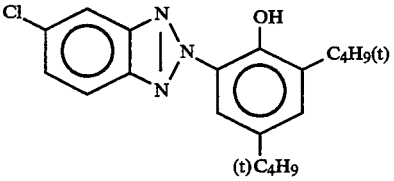
Cpd-3
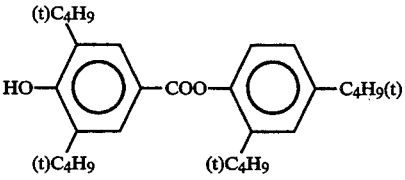

-continued
Cpd-4
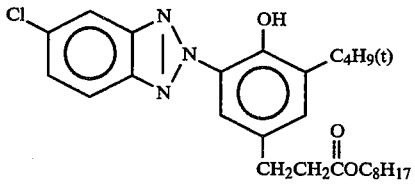
Cpd-5
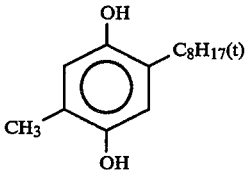
Cpd-6
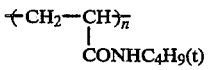
Weight average molecular weight: 30,000
Cpd-7
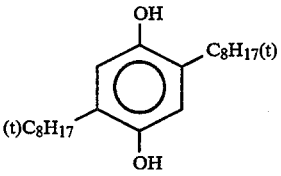
Cpd-8
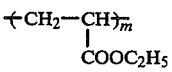
m = 100~1,000
Cpd-9
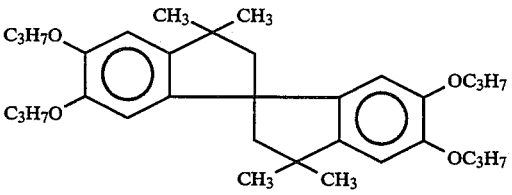
Cpd-10
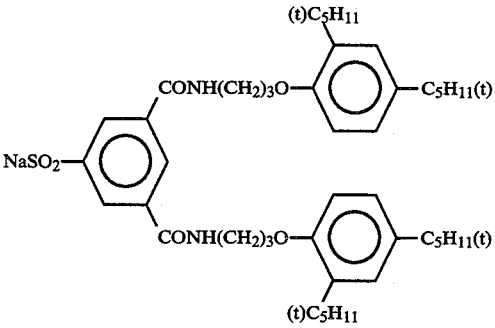
Cpd-11
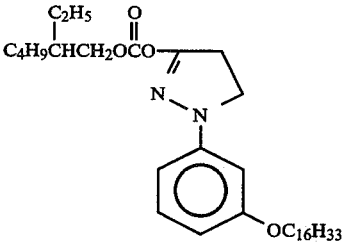

-continued
Cpd-12
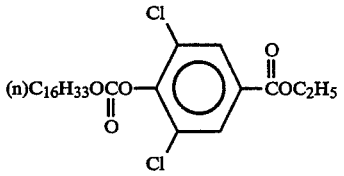
Cpd-13
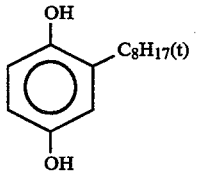
Cpd-14
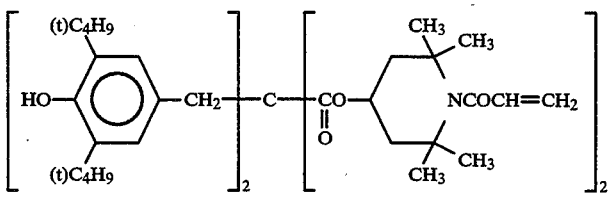
Cpd-15
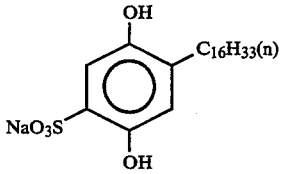
Cpd-16
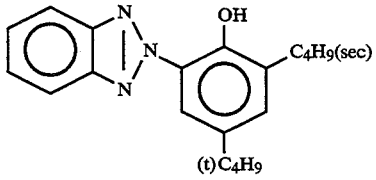
Cpd-17
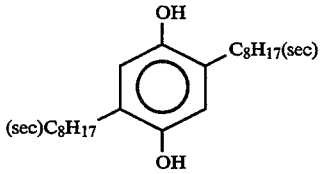
Cpd-18
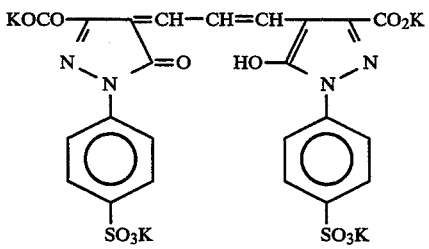
Cpd-19
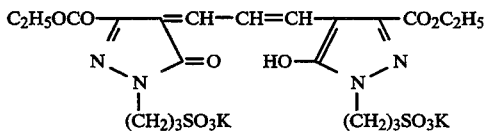

-continued
Cpd-20
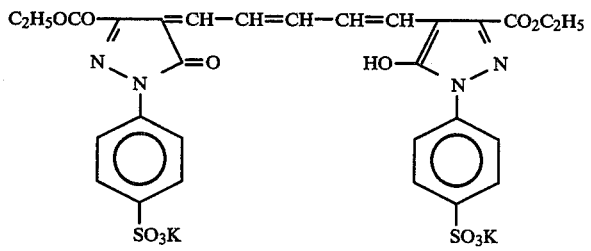
Cpd-21
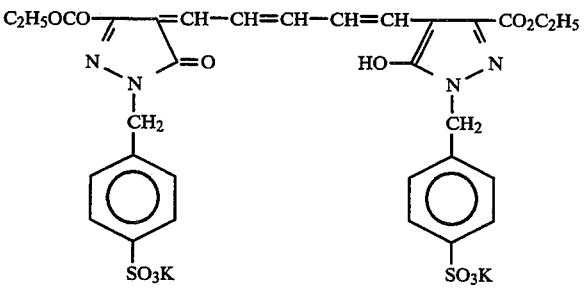
Cpd-22
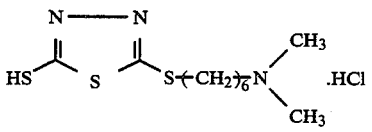
Cpd-23
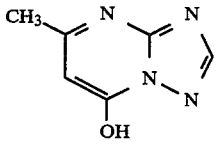
Cpd-24
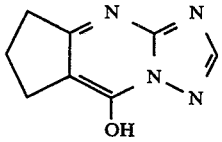
Cpd-25
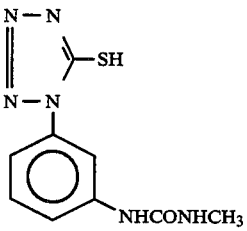
Cpd-26
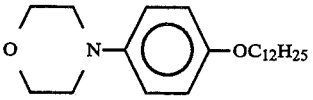
Cpd-27
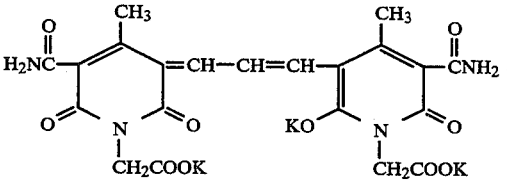
Cpd-28
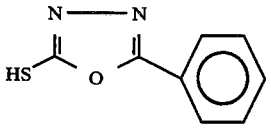

-continued
Cpd-29
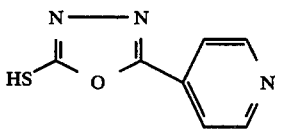
Cpd-30
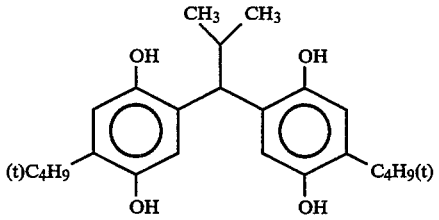
ExC-1
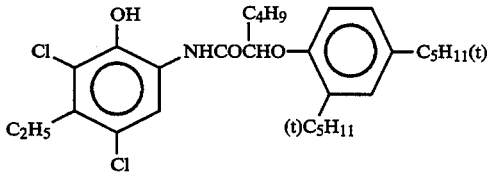
ExC-2
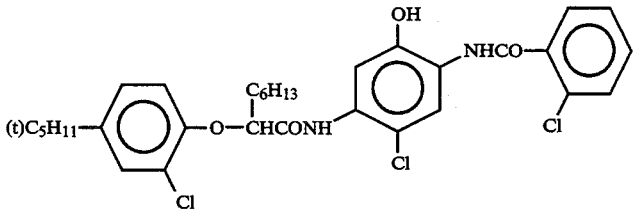
ExC-3
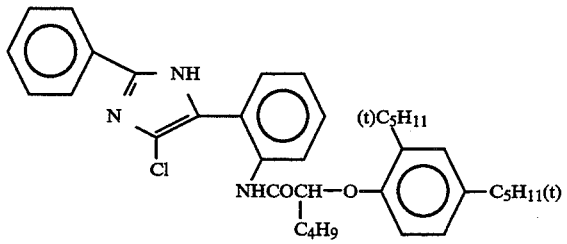
ExM-1
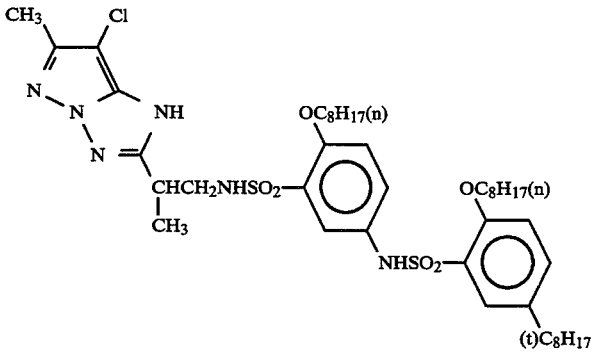

-continued

ExM-2

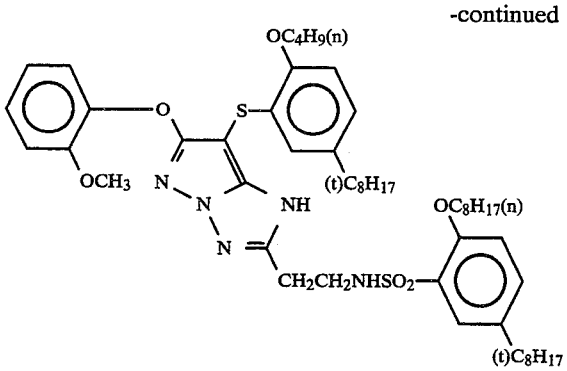

ExM-3

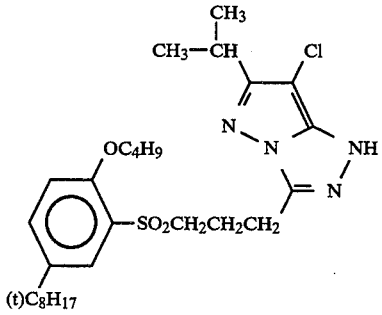

ExY-1

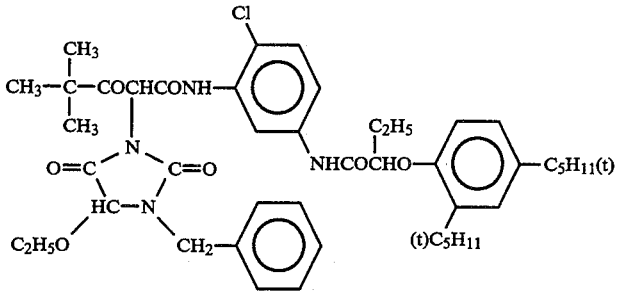

ExY-2

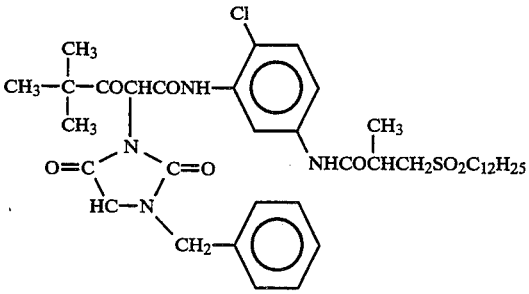

Solv-1: di(2-ethylhexyl)sebacate
Solv-2: trinonyl phosphate
Solv-3: di(3-methyhexyl)phthalate
Solv-4: tricresyl phosphate
Solv-5: dibutyl phthalate
Solv-6: trioctyl phosphate
Solv-7: di(2-ethylhexyl)phthalate
H-1: 1,2-bis(vinylsulfonylacetamide)ethane
H-2: sodium 4,6-dichloro-2-hydroxy-1,3,5-triazine
ExZK-1: 7-(3-ethoxycarbonylaminobenzamide)-9-methyl-10-propargil-1,2,3,4-tetrahydroacrydinium trifluoromethane sulfonate
ExZK-2: 2-[4-{3-[3-{3-[5-{3-[2-chloro-5-(1-dodecyloxycarbonylethoxycarbonyl)phenylcarbamoyl]-4-hydroxy-1-naphthylthio}tetrazole-1-yl]phenyl}-ureido]benzenesulfonamide}phenyl]-1-formylhydrazine Additional samples were prepared according to Sample 201 thus prepared, except that the cyan couplers ExC-1 and ExC-2 contained in the third layer and fourth layer were replaced with the cyan couplers C-3, C-4, C-16, C-19 and C-31 of the present invention so that the added amounts became equimolar, and that the yellow couplers ExY-1 and ExY-2 contained in the eleventh layer and twelfth layer were replaced with the yellow couplers Y-1, Y-4, Y-8, Y-15 and Y-21 of the present invention so that the added amounts became equimolar. The samples thus prepared were imagewise exposed and then processed in the manner described below.

| Processing step | Time | Temperature |
|---|---|---|
| Color developing | 135 seconds | 38° C. |
| Bleach/fixing | 40 seconds | 34° C. |
| Rinsing (1) | 40 seconds | 32° C. |
| Rinsing (2) | 40 seconds | 32° C. |
| Drying | 30 seconds | 80° C. |

The compositions of the respective processing solutions were as follows:

| | |
|---|---|
| Color developing solution | |
| D-sorbit | 0.15 g |
| Condensation product of sodium naphthalenesulfonate and formalin | 0.15 g |
| Pentasodium nitrilotris(methylene-phosphonic acid) | 1.8 g |
| Diethylenetriaminepentacetic acid | 0.5 g |
| 1-Hydroxyethylidene-1,1-diphosphonic acid | 0.15 g |
| Diethylene glycol | 12.0 ml |
| Benzyl alcohol | 13.5 ml |
| Potassium bromide | 0.70 g |
| Benzotriazole | 0.003 g |
| Sodium sulfite | 2.4 g |
| Disodium N,N-bis(sulfonatethyl)-hydroxylamine | 8.0 g |
| Triethanolamine | 6.0 g |
| N-ethyl-N-(β-methanesulfonamidethyl)-3-methyl-4-aminoaniline 3/2 sulfate monohydrate | 6.0 g |
| N,N-bis(carboxymethyl)hydrazine | 4.0 g |
| Potassium carbonate | 30.0 g |
| Fluorescent whitening agent (diaminostilbene type) | 1.3 g |
| Water was added to | 1000 ml |
| pH (25° C., adjusted with KOH or sulfuric acid) | 10.30 |
| Bleach/fixing solution | |
| Disodium ethylenediaminetetracetate dihydrate | 4.0 g |
| Iron (III) ammonium ethylenediamine-tetracetate | 55.0 g |
| Ammonium thiosulfate (750 g/liter) | 168 ml |
| Sodium p-toluenesulfinate | 30.0 g |
| Ammonium sulfite | 35.0 g |
| 5-Mercapto-1,3,4-triazole | 0.5 g |
| Ammonium nitrate | 10.0 g |
| Water was added to | 1000 ml |
| pH (25° C., adjusted with ammonia water or acetic acid) | 6.5 |
| Rinsing solution | |
| Sodium chlorinated isocyanurate | 0.02 g |
| Deionized water (dielectric constant: 5 μs/cm or less) | 1000 ml |
| pH | 6.5 |

These samples also were subjected to evaluation of color reproducibility in the same manner as Example 1 to obtain almost the same results as those obtained in Example 1.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having thereon a silver halide emulsion layer containing a yellow dye-forming coupler, a silver halide emulsion layer containing a magenta dye-forming coupler, and a silver halide emulsion layer containing a cyan dye-forming coupler, wherein the silver halide emulsion layer containing the cyan dye-forming coupler contains at least one cyan dye-forming coupler represented by formula (I) or (II) and the silver halide emulsion layer containing the yellow dye-forming coupler contains at least one yellow dye-forming coupler represented by formula (III):

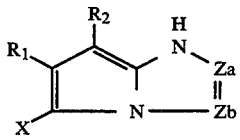
(I)

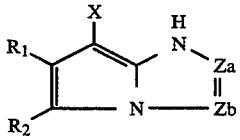
(II)

wherein Za represents—C($R_3$)= and Zb represents —N=; $R_1$ and $R_2$ each represents an electron attractive group having a Hammett's substituent constant $\sigma_p$ of 0.2 or more and the sum of the $\sigma_p$ values of $R_1$ and $R_2$ is 0.65 or more; $R_3$ represents a hydrogen atom or a substituent; X represents a hydrogen atom or a group capable of splitting off upon a reaction with an oxidation product of an aromatic primary amine color developing agent; the group represented by $R_1$, $R_2$, $R_3$ or X may be a divalent group and combine with a polymer which is higher than a dimer and which has a high molecular chain to form a homopolymer or a copolymer;

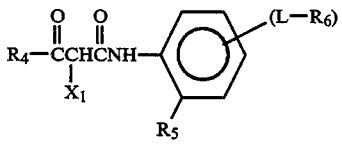
(III)

wherein $R_4$ represents an aryl group or a tertiary alkyl group; $R_5$ represents a fluorine atom, an alkyl group, an aryl group, an alkoxy group, an aryloxy group, a dialkylamino group, an alkylthio group, or an arylthio group; L represents —O—*, —COO—*, —NHCO—*, —NHCOCHR$_7$—*, —NHCO(CH$_2$)$_m$—*, —CONH—*, —CONH(CH$_2$)$_m$—*, —CONHCHR$_7$—*, —SO$_2$NR$_7$(CH$_2$)$_m$—*, —NHSO$_2$—*, or —NHSO$_2$(CH$_2$)$_m$—*; $R_7$ represents a hydrogen atom or an alkyl group; * represents the bonding direction to $R_6$; m represents an integer of 1 to 4; $R_6$ represents a halogen atom, an unsubstituted alkyl group, an unsubstituted aryl group, an unsubstituted alkoxy group, an unsubstituted aryloxy group, an alkyl-substituted aryl group, an alkoxy-substituted aryl group, an alkyl-substituted aryloxy group, or an aralkyloxy group; $X_1$ represents a hydrogen atom or a group capable of splitting off upon a reaction with an oxidation product of an aromatic primary amine color developing agent; and r represents an integer of 0 to 4, provided that when r is plural, the plural L-$R_6$ groups are the same or different.

2. The silver halide color photographic light-sensitive material of claim 1, wherein $R_3$ represents a hydrogen atom, a halogen atom, an alkyl group, an aryl group, a heterocyclic group, a cyano group, a hydroxy group, a nitro group, a carboxy group, a sulfo group, an amino group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonylamino group, an imido group, a heterocyclic thio group, a sulfinyl group, a phosphonyl group, an aryloxycarbonyl group, an acyl group, or an azolyl group.

3. The silver halide color photographic light-sensitive material of claim 1, wherein $R_1$ and $R_2$ each independently represents an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with an electron attractive group having $\sigma_p$ of 0.20 or more, a heterocyclic group, a halogen atom, an azo group, or a selenocyanate group.

4. The silver halide color photographic light-sensitive material of claim 1, wherein X represents a hydrogen atom, a halogen atom, an alkoxy group, an aryloxy group, an acyloxy group, an alkyl or arylsulfonyloxy group, an acylamino group, an alkyl or arylsulfonamido group, an alkoxycarbonyloxy group, an aryloxycarbonyloxy group, an alkyl, aryl or heterocyclic thio group, a carbamoylamino group, a 5-membered or 6-membered nitro-gen-containing heterocyclic group, an imido group, or an arylazo group.

5. The silver halide color photographic light-sensitive material of claim 1, wherein the silver halide emulsion layer containing the cyan dye-forming coupler represented by formula (I) or (II) is a red-sensitive emulsion layer.

6. The silver halide color photographic light-sensitive material of claim 1, wherein the cyan dye-forming coupler is represented by formula (I).

7. The silver halide color photographic light-sensitive material of claim 1, wherein the cyan dye-forming coupler represented by formula (I) or (II) is present in an amount of $1\times10^{-3}$ mol to 1 mol per mol of silver halide in said silver halide emulsion layer containing the cyan dye-forming coupler.

8. The silver halide color photographic light-sensitive material of claim 1, wherein the yellow dye-forming coupler represented by formula (III) is present in an amount of $1\times10^{-5}$ to $1\times10^{-2}$ mol per $m^2$ of light-sensitive material.

9. The silver halide color photographic light-sensitive material of claim 1, wherein the magenta dye-forming coupler is represented by formula (M):

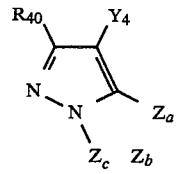

(M)

wherein $R_{40}$ represents a hydrogen atom or a substituent; $Z_a$, $Z_b$ and $Z_c$ each represents methine, substituted methine, =N—, or —NH—; one of the $Z_a$–$Z_b$ bond and the $Z_b$–$Z_c$ bond is a double bond and the other is a single bond; where the $Z_b$–$Z_c$ bond is a carbon-carbon double bond, it is a part of an aromatic ring; $Y_4$ represents a hydrogen atom or a group capable of splitting off upon a reaction with an oxidation product of an aromatic primary amine color developing agent; and where $R_{40}$, or $Y_4$ are substituents or $Z_a$, $Z_b$ and $Z_c$ are substituted methines, a polymer higher than a dimer is formed with the substituents thereof.

10. The silver halide color photographic light-sensitive material of claim 2, wherein $R_3$ represents an alkyl group or an aryl group.

11. The silver halide color photographic light-sensitive material of claim 3, wherein $R_1$ and $R_2$ each represents an alkoxycarbonyl group, a nitro group, a cyano group, an arylsulfonyl group, a carbamoyl group, a halogenated alkyl group or an aryloxycarbonyl group.

12. The silver halide color photographic light-sensitive material of claim 13, wherein $R_1$ represents a cyano group and $R_2$ represents a branched alkoxycarbonyl group.

13. The silver halide color photographic light-sensitive material of claim 4, wherein X represents a halogen atom, an alkylthio group or an arylthio group.

14. The silver halide color photographic light-sensitive material of claim 1, wherein the silver halide emulsion layer containing the yellow dye-forming coupler is a blue-sensitive emulsion layer and the silver halide emulsion layer containing the magenta dye-forming coupler is a green-sensitive emulsion layer.

15. The silver halide color photographic light-sensitive material of claim 1, wherein $R_4$ represents an alkoxyaryl group or a tertiary butyl group.

* * * * *